US010747174B2

(12) United States Patent
Shigihara

(10) Patent No.: US 10,747,174 B2
(45) Date of Patent: Aug. 18, 2020

(54) SENSOR UNIT AND IMAGE FORMING APPARATUS

(71) Applicant: CANON KABUSHIKI KAISHA, Tokyo (JP)

(72) Inventor: Keita Shigihara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/512,796

(22) Filed: Jul. 16, 2019

(65) Prior Publication Data

US 2020/0026236 A1 Jan. 23, 2020

(30) Foreign Application Priority Data

Jul. 19, 2018 (JP) ..... 2018-136194

(51) Int. Cl.
*G03G 21/20* (2006.01)
*G03G 15/00* (2006.01)

(52) U.S. Cl.
CPC ..... *G03G 21/206* (2013.01); *G03G 15/5041* (2013.01)

(58) Field of Classification Search
None
See application file for complete search history.

(56) References Cited

U.S. PATENT DOCUMENTS 9,317,011 B2 * 4/2016 Mukataka ..... G03G 21/206
2010/0080591 A1 * 4/2010 Takeuchi ..... G03G 15/6532 399/49
2010/0202795 A1 * 8/2010 Dergham ..... G03G 15/0898 399/93

FOREIGN PATENT DOCUMENTS

JP 2001-166622 A 6/2001
JP 2015-197559 A 11/2015
JP 2016-080785 A 5/2016

* cited by examiner

*Primary Examiner* — Roy Y Yi
(74) *Attorney, Agent, or Firm* — Venable LLP

(57) ABSTRACT

A sensor unit includes a plurality of sensors configured to detect a toner image carried on an image bearing member, a duct including a suction portion, and a plurality of branch duct portions. The branch duct portions each includes a discharging portion having a discharge opening. At least one of the branch duct portions includes a first path for discharging air in a direction, and a second path connected with the first path at a downstream position to discharge the air in the direction. The sensor unit further includes a guide portion provided in the second path and extended crossing with an extension of one of inner walls of the first path, the guide portion being capable of branching the air in the second path toward the discharge opening.

12 Claims, 15 Drawing Sheets

(a)

(b)

(a)

(b)

SENSOR UNIT AND IMAGE FORMING APPARATUS

FIELD OF THE INVENTION AND RELATED ART

The present invention relates to a sensor unit which is used in an image forming apparatus such as a copy machine, a printing machine, a facsimile machine, a multifunction machine having two or more functions of the preceding machines, etc. It relates also to an image forming apparatus equipped with a sensor unit such as the one described above.

As a sensor unit for an image forming apparatus, there has been proposed such a sensor unit that has multiple sensors for detecting objects on a moving member, and a casing having openings, through each of which the detection surface of each of the sensors is exposed to the moving member (Japanese Laid-open Patent Application No. 2015-197559). In the case of this type of sensor unit structured as described above, the casing is provided with an intake opening, through which the air in the main assembly of the image forming apparatus is inducted into the casing, and an air passage, through which the inducted air is made to flow out of the casing through the space between the detection surface and the detection openings, in order to prevent the problem that contaminants such as toner adhere to the detection surface. Further, the sensor unit disclosed in the first patent document is structured so that air is indirectly inducted from an external fan.

Here, regarding a structural arrangement for sending air to multiple sensors of a sensor unit, it is possible to structure a sensor unit so that its exhaust openings through which air is discharged toward the sensors are greater in number than its intake opening(s). More specifically, it is possible to provide a sensor unit with multiple branch portions which branch out from the intake opening(s), in such a manner that they extend toward the multiple sensors, one for one. In the case of a sensor unit structured as described above, the greater in distance a given exhaust opening is from the intake opening, the greater it is in the angle at which the air has to change in direction before it comes out of the opening. Therefore, it is sometimes difficult to provide the closer side of the sensor to the intake portion, with such airflow that is desirable in amount and direction. If a sensor cannot be provided with such airflow that is desirable in amount and direction, it is impossible to satisfactorily prevent soiling matters from adhering to the sensors.

SUMMARY OF THE INVENTION

Thus, the primary object of the present invention is to provide a sensor unit structured so that its exhaust openings are greater in number than its intake openings, and yet, it can prevent soiling matters from adhering its sensor.

According to an aspect of the present invention, there is provided a sensor unit comprising a plurality of sensors configured to detect a toner image carried on an image bearing member; a duct configured to feed air to surfaces of said plurality of sensors, wherein said duct includes a suction portion having a suction opening configured to take the air in, a plurality of branch duct portions configured to branch the air taken in through said suction opening and to feed the air toward said sensors; wherein said branch duct portions each include a discharging portion having a discharge opening configured to discharge the air passed through the branch duct portions; wherein at least one of said branch duct portions includes a first path portion disposed at an upstream position and configured to discharge the air in a direction, and a second path portion connected with said first path portion at a downstream position and configured to discharge the air in a direction which is different from the direction in which said first path portion discharges the air; said duct further including a guide portion provided in said second path portion and extended crossing with an extension of one of inner walls of said first path portion, said guide portion being capable of branching the air in said second path portion toward said discharge opening.

Further features of the present invention will become apparent from the following description of exemplary embodiments with reference to the attached drawings.

Figure 8:
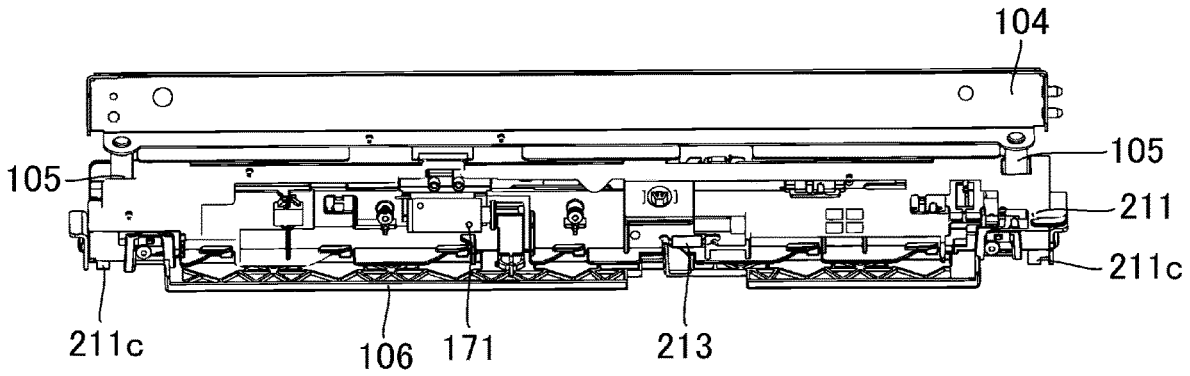
Figure 8:
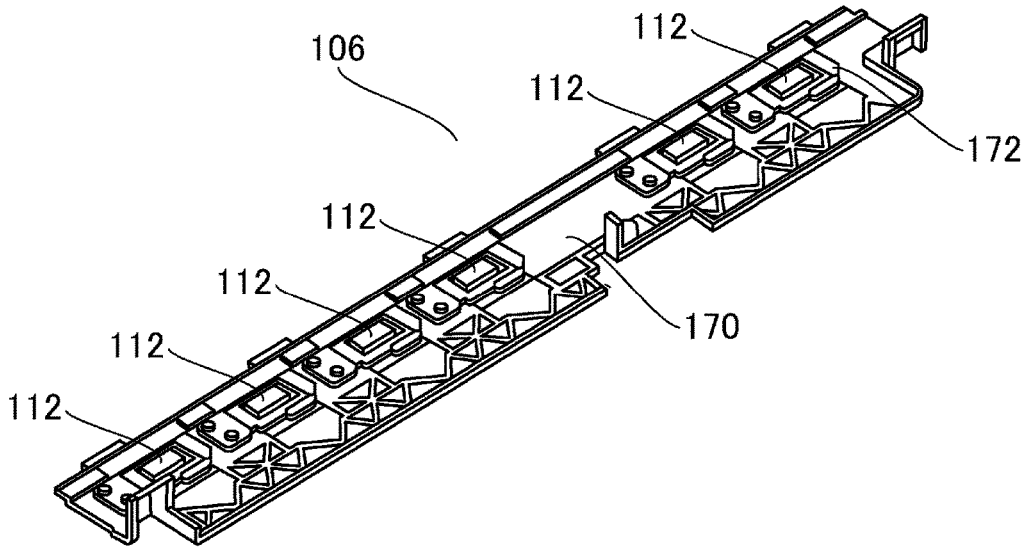

Part (a) and part (b) of FIG. 8 are a side view and a perspective view of the shuttering member, respectively, when the shuttering member is closed.

Figure 9:
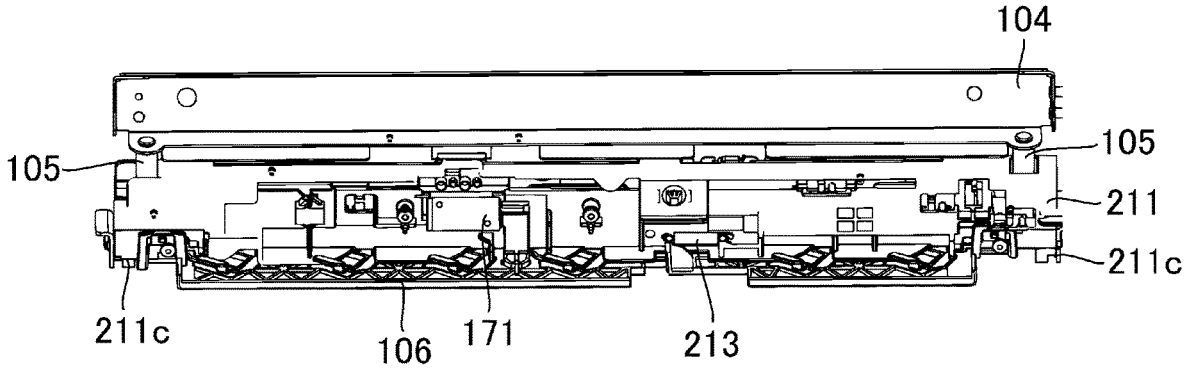
Figure 9:
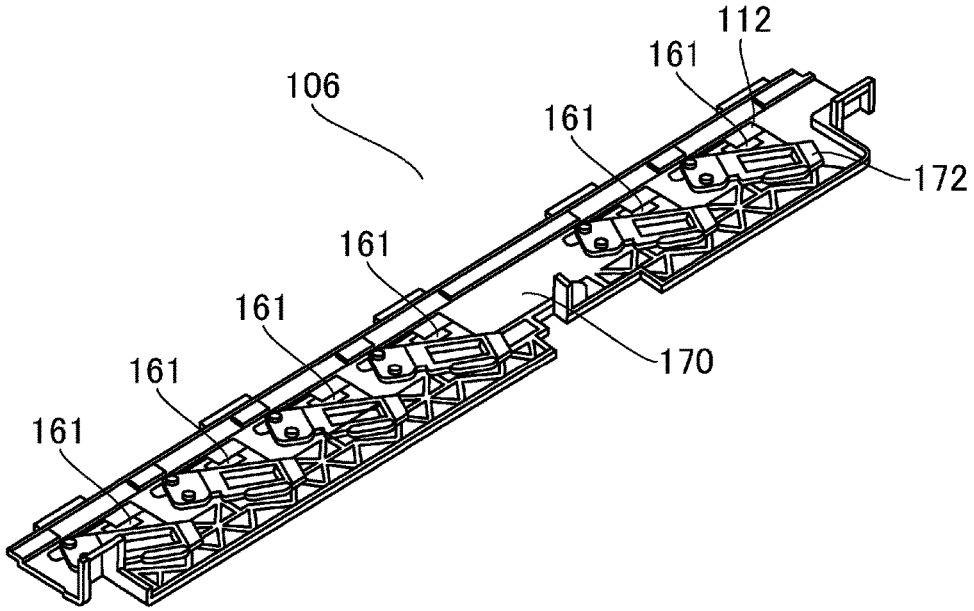

Part (a) of FIG. 9 and part (b) of FIG. 9 are a side view and a perspective view of the shuttering member, respectively, when the shuttering member is open.

Figure 10:
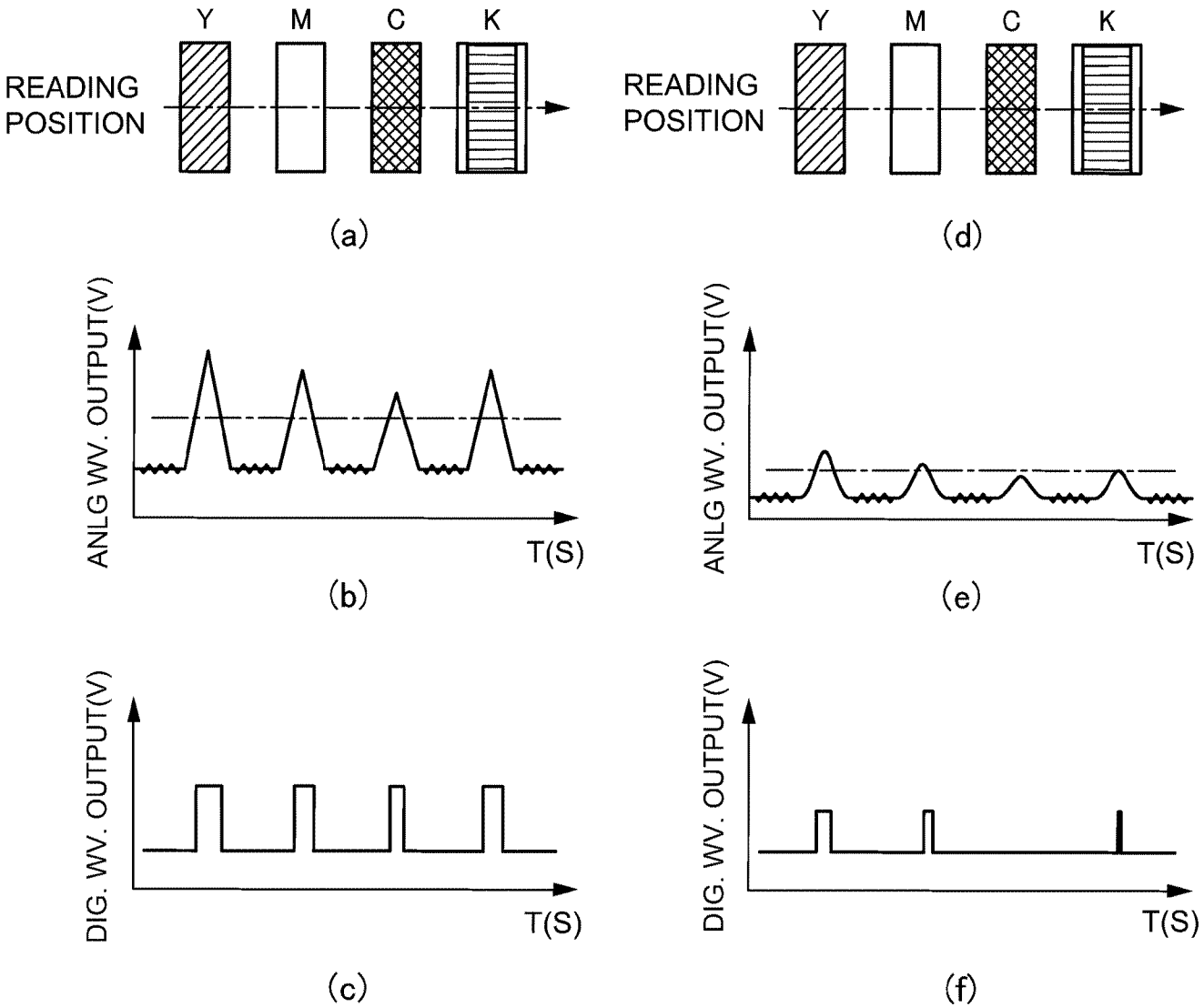

Parts (a)-(f) of FIG. 10 show the registration patches and waveforms of outputs of the sensor unit, in which part (a) shows the registration patches, part (b) shows a waveform of analog output of the sensor unit, and part (c) shows a waveform of the digitized output of the sensor unit when the registration sensors are not soiled; and part (d) shows the relationship among the registration patches, part (e) is a waveform of analog output of the sensor unit, and part (f) is a waveform of the digitized output of the sensor unit when the registration sensors are soiled.

Figure 11:
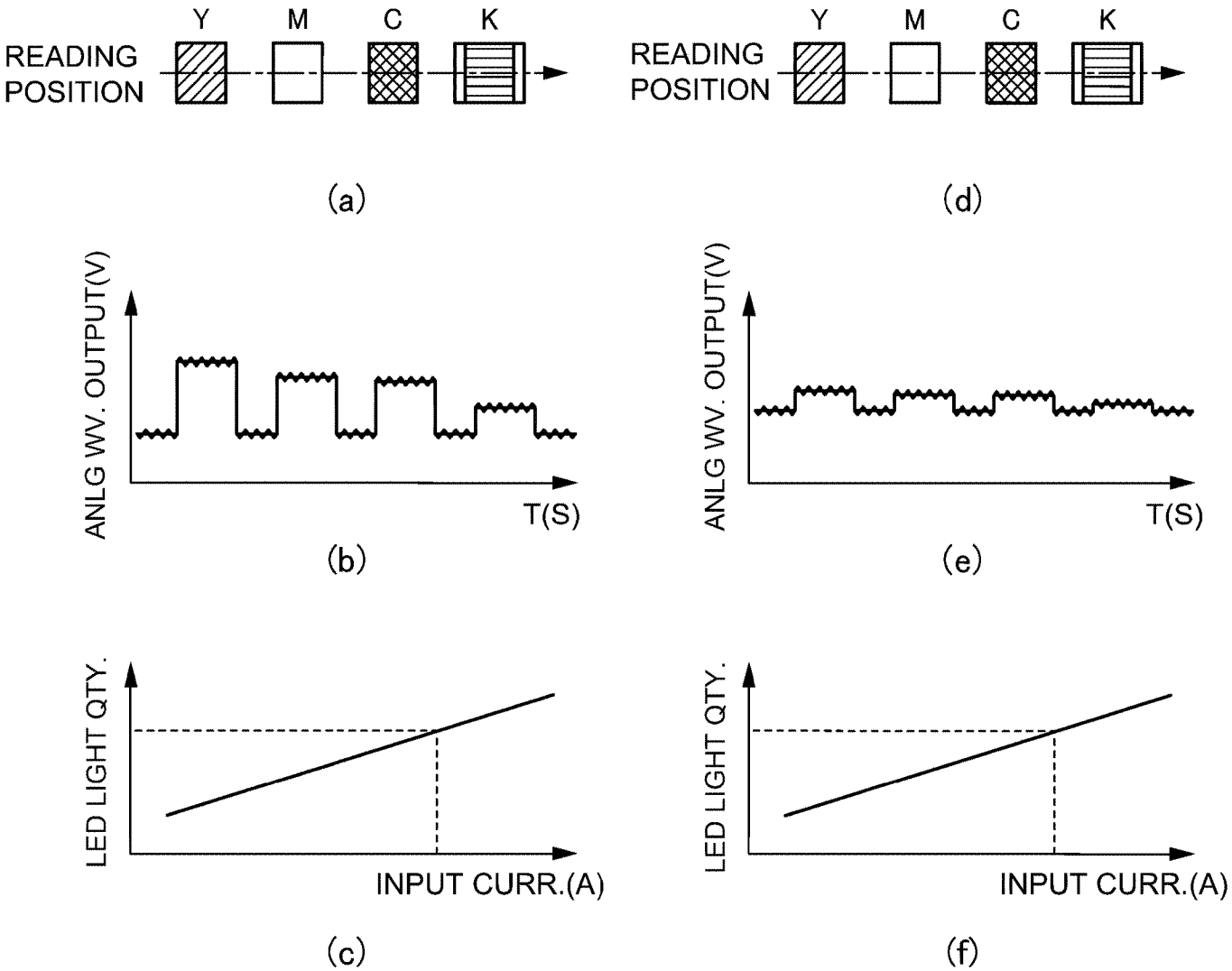

Parts (a)-(f) of FIG. 11, are drawings for showing the relationship among the density patches (part (a)), waveform of analog output (part (b)) of the sensor unit, and LED output (part (c)) of the digitized output of the sensor unit when the density sensors are not soiled, and the relationship among the density patches (part (d)), waveform of analog output (part (e)) of the sensor unit, and LED output (part (f)) of the digitized output of the sensor unit when the registration sensors are soiled.

Figure 12:
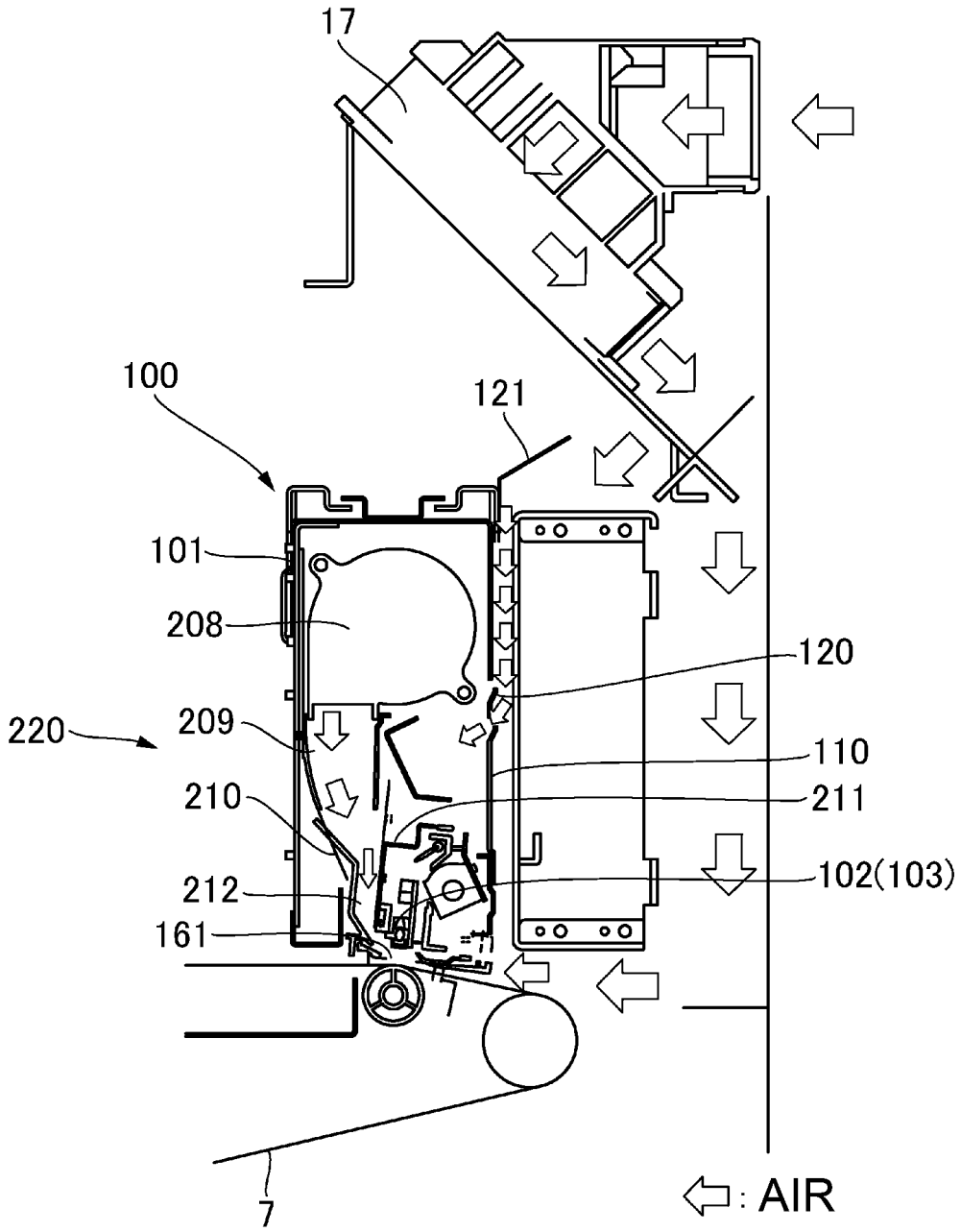

FIG. 12 is sectional view of the sensor unit and the adjacencies thereof, in the first embodiment, at a plane which is parallel to the rotational direction of the intermediary transfer belt; it shows the airflow in the adjacencies of the sensor unit.

Figure 13:
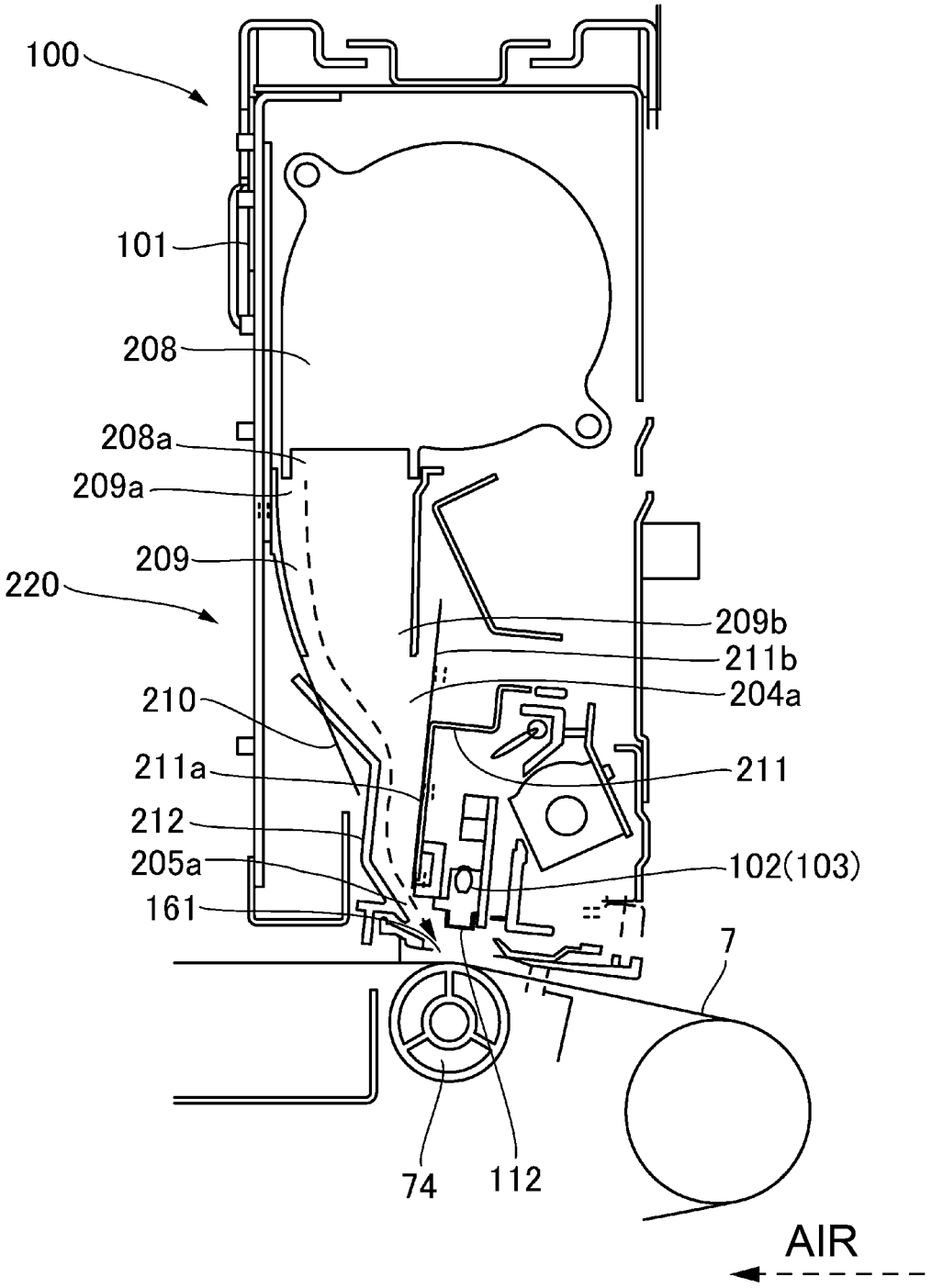

FIG. 13 is a sectional view of the sensor unit in the first embodiment, at a plane which is intersectional to the rotational direction of the intermediary transfer belt; it shows the airflow within the sensor unit.

Figure 14:
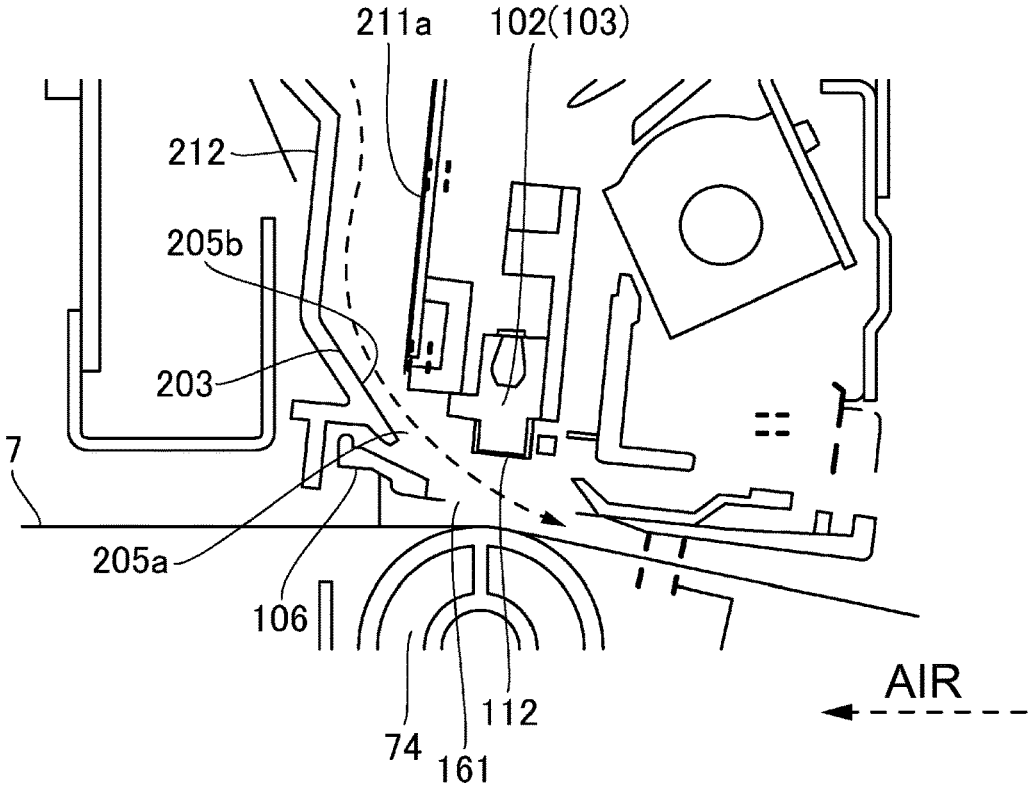

FIG. 14 is an enlarged sectional view of the sensor unit in this embodiment, which is shown in FIG. 13, and its adjacencies.

Figure 15:
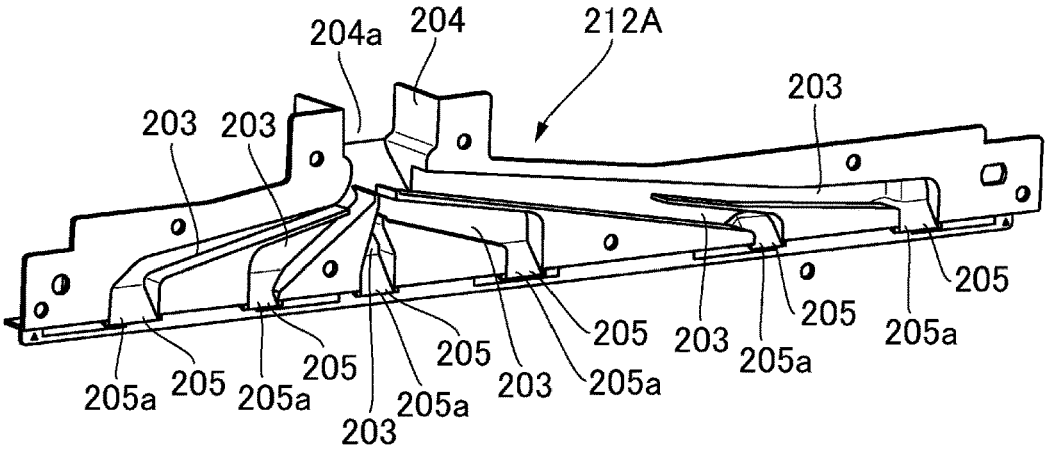

FIG. 15 is a perspective view of a comparative sensor unit duct, as seen from the downstream side of the duct, in terms of the rotational direction of the intermediary transfer belt.

Figure 16:
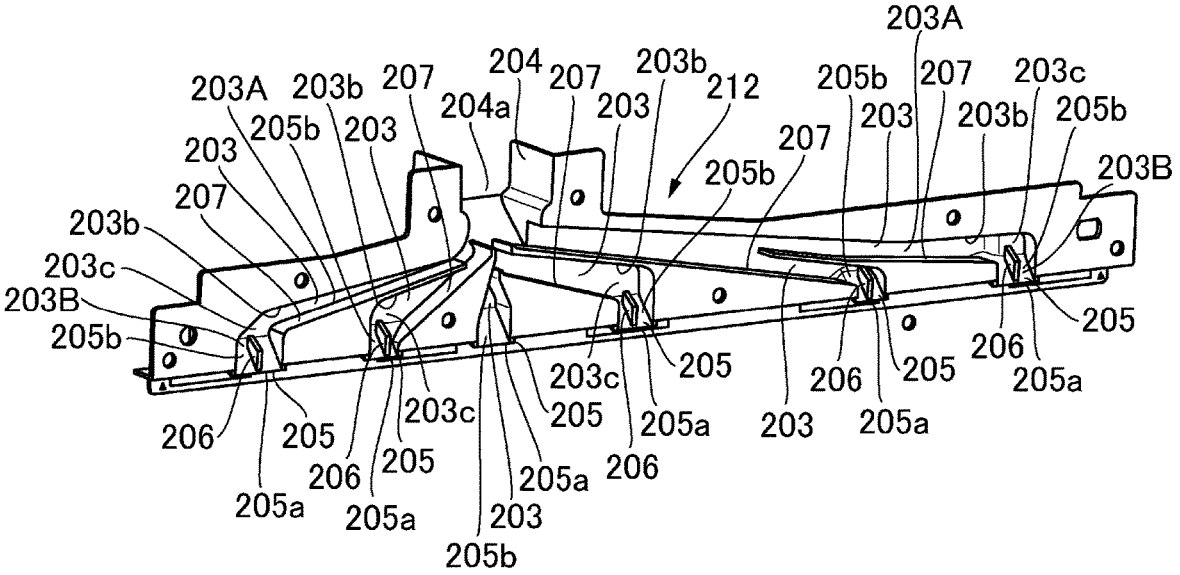

FIG. 16 is a perspective view of the sensor unit duct in the first embodiment, as seen from the downstream side of the duct in terms of the rotational direction of the intermediary transfer belt.

Figure 17:
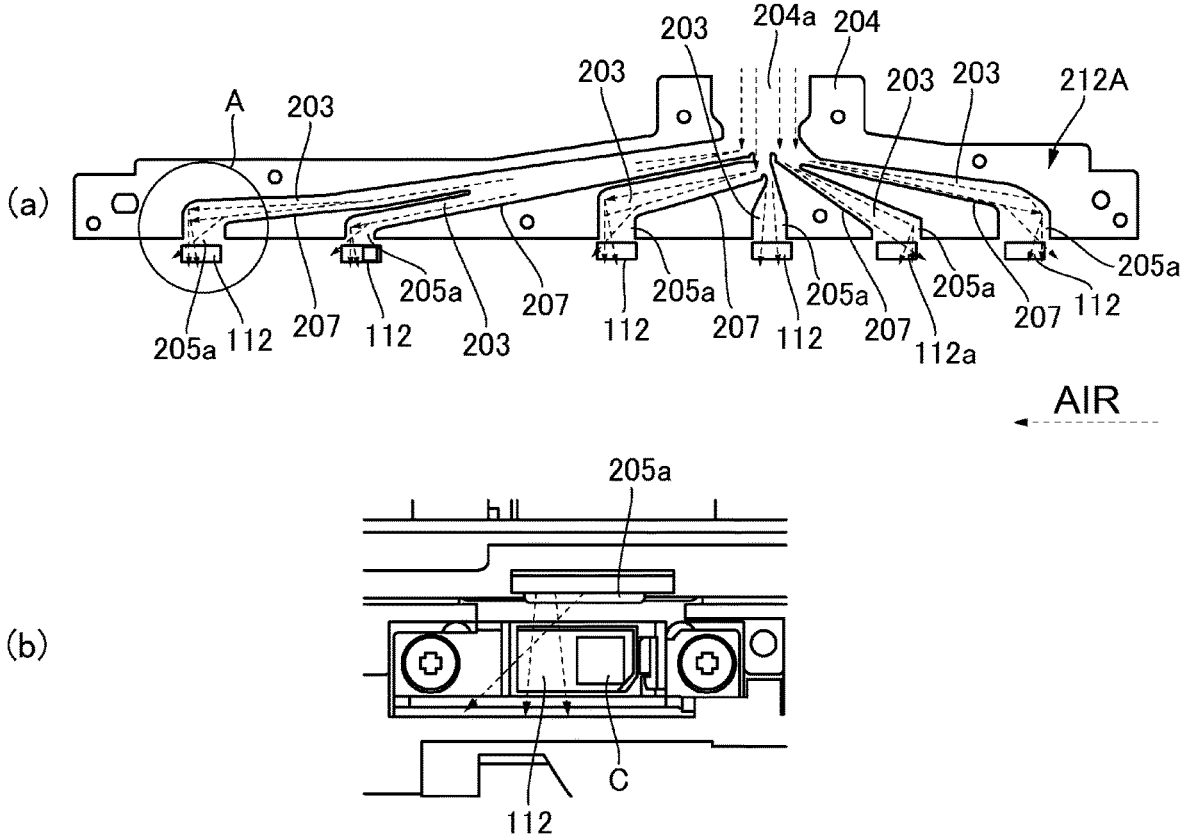

Part (a) of FIG. 17 is a sectional view of the comparative sensor unit duct, which shows the airflow in the sensor unit duct; and part (b) of FIG. 17 is an enlarged sectional view of a portion A of the sensor unit duct in part (a) of FIG. 17, as seen from the top side of FIG. 13.

Figure 18:
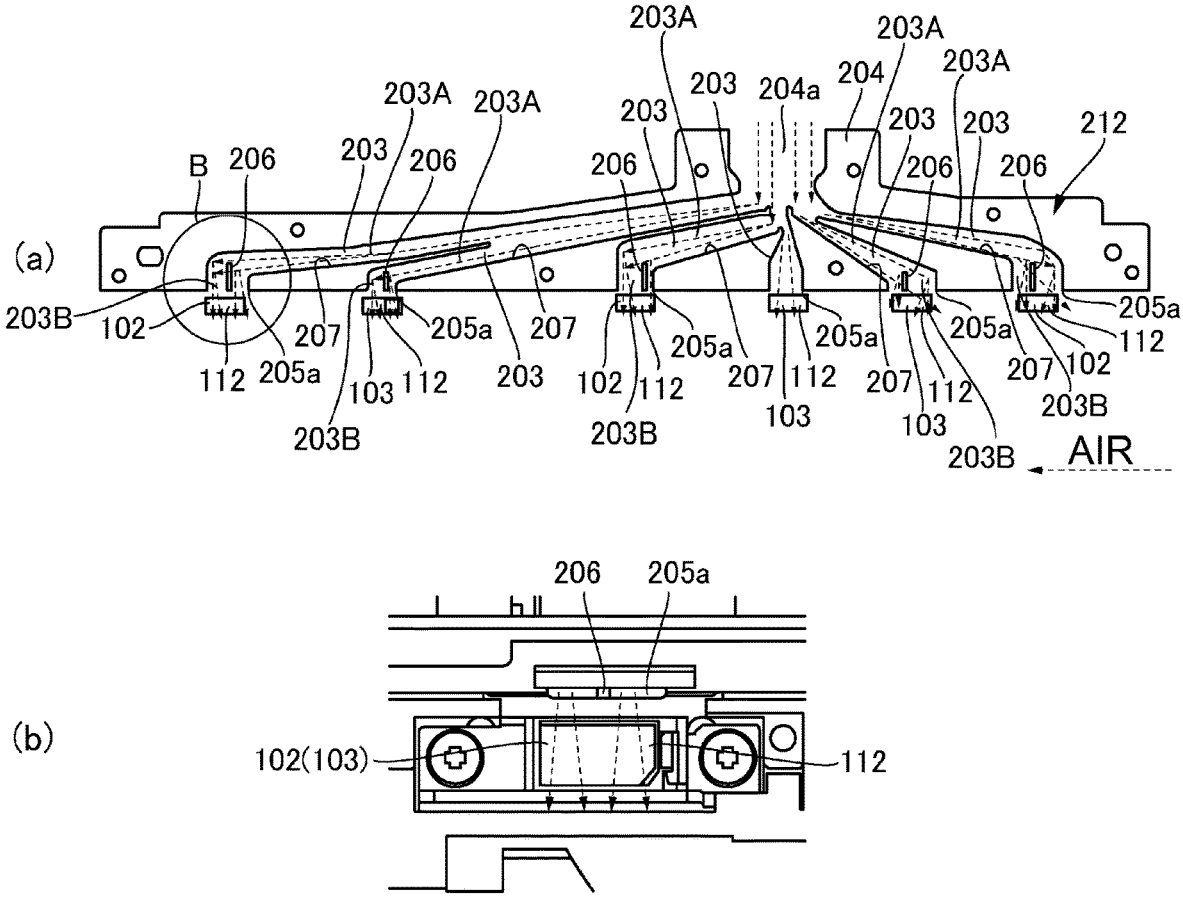

Part (a) of FIG. 18 is a sectional view of the sensor unit duct in the first embodiment, which shows the airflow in the duct, and part (b) of FIG. 18 is an enlarged top view of a portion B of the sensor unit duct in part (a) of FIG. 18, as seen from the top side of FIG. 13.

Figure 19:
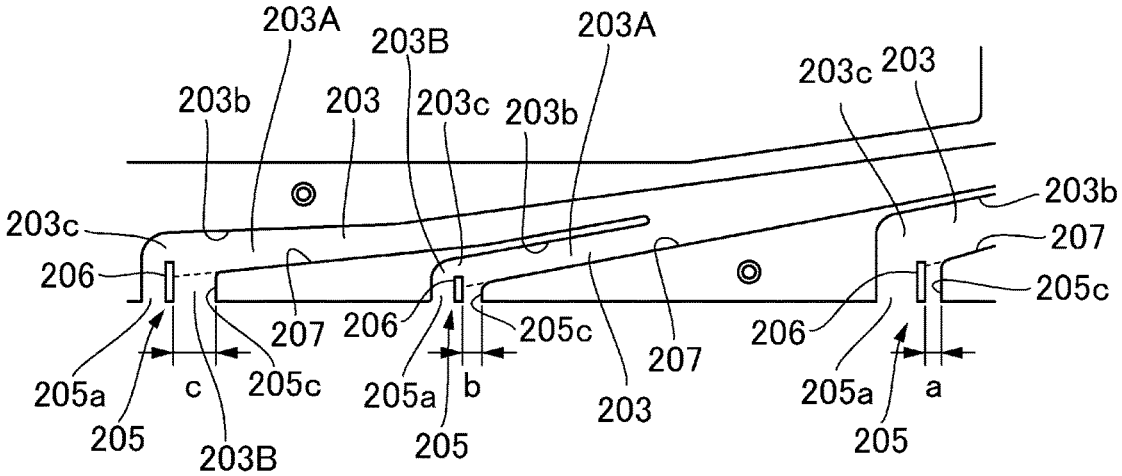

FIG. 19 is a sectional view of a part of the sensor unit duct; it is for showing the positioning of the air-distribution plates in the first embodiment.

Figure 20:
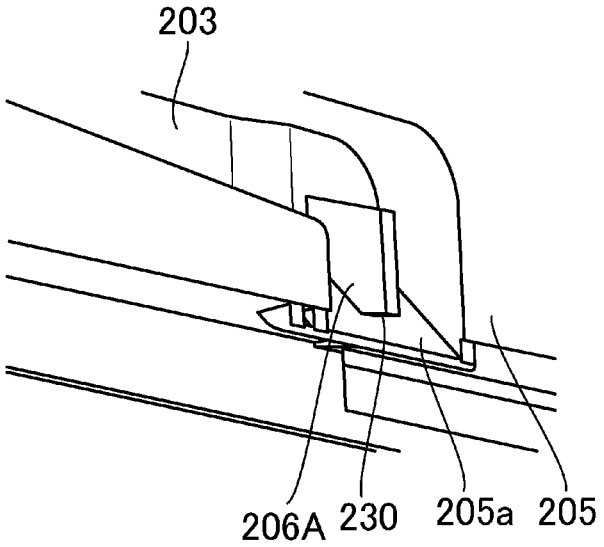

FIG. 20 is a perspective view of a part of the sensor unit duct in the second embodiment of the present invention; it shows the air-distribution plates in the second embodiment.

Figure 21:
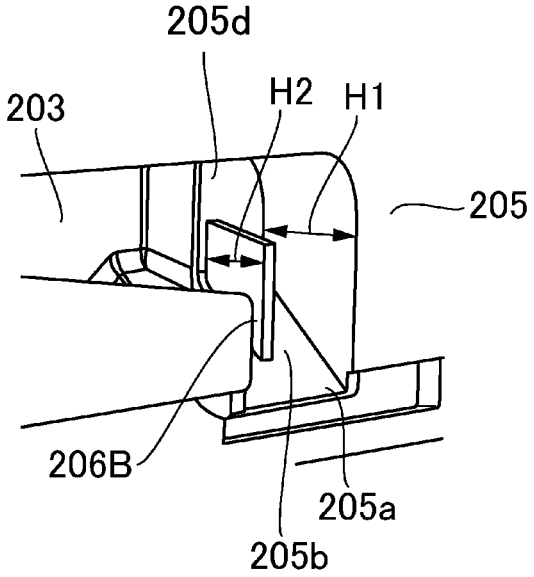

FIG. 21 is a perspective view of a part of the sensor unit duct in the third embodiment of the present invention.

DESCRIPTION OF THE EMBODIMENTS

Hereinafter, referring to FIGS. 1 to 14, the present invention is described with reference to one of the preferred embodiments of the present invention. To begin with, referring to FIG. 1, the general structure of the image forming apparatus in this embodiment is described.

[Image Forming Apparatus]

The image forming apparatus 10 in this embodiment is a color copying machine which is capable of forming a full-color image with the use of one of electrophotographic methods. It is of the so-called intermediary transfer type, and also, of the so-called tandem type. The image forming apparatus 10 has multiple (four) image forming portions, more specifically, the first to fourth image forming portions (stations) PY, PM, PC and PK, which form yellow (Y), magenta (M), cyan (C) and black (K) images, respectively. In this embodiment, the image forming portions PY, PM, PC and PK are practically the same in structure and operation, although they are different in the color of the toner they use. Therefore, the first image forming portion PY is primarily described; the other image forming portions are not described.

Figure 1:
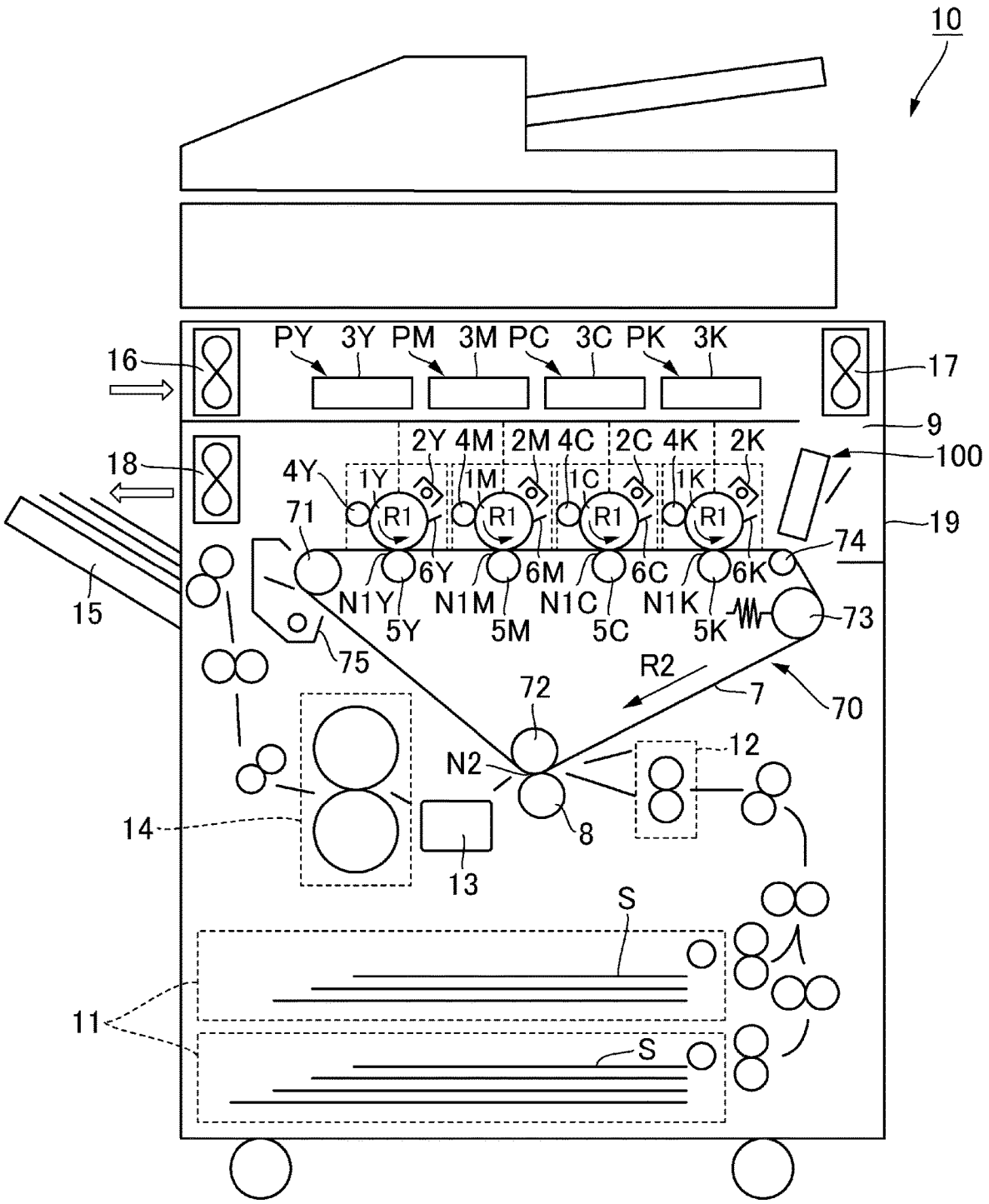
FIG. 1 is a sectional view of the image forming apparatus in one of the preferred embodiments of the present invention; it shows the general structure of the apparatus.

In the following description of the present invention, the portion of the image forming apparatus 10 shown in FIG. 1 is referred to as the front side (surface) of the image forming apparatus 10, and the opposite portion of the image forming apparatus 10 is referred to as the rear side (rear surface) of the image forming apparatus 10. Here, the front side of the image forming apparatus 10 means the side from which an operator operates the image forming apparatus 10. It is the side having a portion for operating the image forming apparatus 10. Further, the left and right sides of the image forming apparatus 10 are the left and right sides as the image forming apparatus 10 is seen from its front side. It is assumed here that the depth direction, or the direction which connects the front and rear sides, is roughly parallel to the rotational axis of the photosensitive drum 1Y, which will be described later.

The image forming portion PY is provided with a photosensitive drum 1Y as an image bearing member. The photosensitive drum 1Y is an electrophotographic member (photosensitive member) which is in the form of a drum (cylindrical). The photosensitive drum 1Y is rotationally driven in the direction indicated by an arrow mark R1 in FIG. 1, by a driving motor (unshown) as a driving means. The image forming portion PY is provided with the following apparatuses, more specifically, a charging device 2Y as a charging means, an exposing apparatus (laser scanning apparatus) as an exposing means, a developing apparatus 4Y as a developing means, a primary transfer roller 5Y as the primary transferring member which is in the form of a roller, and a drum cleaner 6Y as a means for cleaning the photosensitive drum 1Y. These apparatuses are disposed in the listed order, in the adjacencies of the peripheral surface of the photosensitive drum 1Y, in a manner to surround the photosensitive drum 1Y in the direction parallel to the rotational direction of the photosensitive drum 1Y.

As the photosensitive drum 1Y is rotated, it is uniformly charged by the charging device 2Y. Then, the charged peripheral surface of the photosensitive drum 1Y is scanned by the exposing apparatus 3Y (scanned by beam of light from exposing apparatus 3Y). As a result, an electrostatic latent image (electrostatic image) is formed on the peripheral surface of the photosensitive drum 1Y. This electrostatic latent image is developed by the developing apparatus 4Y which uses toner as developer.

By the way, the exposing apparatus 3Y is provided with a laser and multiple mirrors. The laser is controlled in light emission by image formation signals. The multiple mirrors are for guiding the beam of laser light to the peripheral surface of the photosensitive drum 1Y. The timing with which a latent image begins to be written can be adjusted by adjusting the exposing apparatus in the timing with which the beam of laser light is emitted, and also, adjusting the mirrors, in order to adjust the image forming apparatus 10 in the point on the peripheral surface of the photosensitive drum 1Y, at which a latent image begins to be written. Further, the image forming apparatus 10 can be adjusted in image density by adjusting the potential level to which the peripheral surface of the photosensitive drum 1Y is to be charged, and also, adjusting the exposing apparatus 3Y in the intensity of the laser light.

On the other hand, the image forming apparatus 10 is provided with an intermediary transfer belt 7 as an intermediary transferring member which is in the form of an endless belt. The intermediary transfer belt 7 is on the bottom side of the combination of the photosensitive drums 1Y, 1M, 1C and 1K, being disposed in a manner to horizontally penetrate each of the image forming portions PY, PM, PC and PK. The intermediary transfer belt 7 is an example of movable member, to which the present invention is related. It is disposed in a manner to wrap around a combination of multiple supporting rollers (suspending and tensioning rollers), more specifically, a driving roller 71, a roller 72 which opposes the secondary transferring member, a tension roller 73, and a backup roller 74.

As driving force is inputted into the driving roller 71 from a driving motor (unshown) as a driving means, the intermediary transfer belt 7 rotates (circularly moves) in the direction indicated by the arrow mark R2 in the drawing. The tension roller 3 remains pressed outward from the inward side of the loop (belt loop) which the intermediary transfer belt 7 forms. That is, the intermediary transfer belt 7 remains suspended by the abovementioned supporting rollers while being subjected to a preset amount of tension. Further, the image forming apparatus 10 is provided with primary transfer rollers 5Y, 5M, 5C and 5K, which also are positioned on the inward side of the loop which the intermediary transfer belt 7 forms, being disposed in a manner to oppose the photosensitive drums 1Y, 1M, 1C and 1K, respectively.

The primary transfer roller 5Y is kept pressed toward the photosensitive drum 1Y with the presence of the intermediary transfer belt 7 between the primary transfer roller 5Y and photosensitive drum 1Y. Therefore, the primary transferring portion N1Y (primary transfer nip), which is the interface between the intermediary transfer belt 7 and photosensitive drum 1Y, is formed between the intermediary transfer belt 7 and photosensitive drum 1Y.

Further, the image forming apparatus 10 is provided with a secondary transfer roller 8 as the secondary transferring means, which is the secondary transferring member and is in the form of a roller. The secondary transfer roller 8 is disposed on the outward side of the loop which the intermediary transfer belt 7 forms, in such a manner that it opposes the roller 72 (which opposes secondary transfer roller 8). The secondary transfer roller 8 is kept pressed toward the roller 72 with the presence of intermediary transfer belt 7 between the secondary transfer roller 8 and roller 72. Thus, the secondary transferring portion N2 (secondary transfer nip), or the interface between the secondary transfer roller 8 and roller 72, is formed.

Further, the image forming apparatus 10 is provided with the belt cleaner 75 as a means for cleaning the intermediary transfer belt 7, which also is disposed on the outward side of the loop which the intermediary transfer belt 7 forms, in a manner to oppose the driving roller 71. The belt unit 70 comprises the intermediary transfer belt 7, belt supporting rollers 71, 72, 73 and 75, belt cleaner 75, etc.

After the formation of a toner image on the peripheral surface of the photosensitive drum 1Y, the toner image is transferred (primary transfer) onto the intermediary transfer belt 7 by the function of the primary transfer roller 5Y, to which the primary transfer voltage (primary transfer bias) is applied, in the primary transferring portion N1Y. For example, in an operation for forming a full-color image, first, a yellow toner image is transferred onto the intermediary transfer belt 7 in the first image forming portion PY. Then, magenta, cyan and black toner images are sequentially transferred onto the intermediary transfer belt 7 in the second, third and fourth image forming portions PM, PC and PK, respectively, in a manner to be layered upon the preceding toner image on the intermediary transfer belt 7. Then, the layered toner images on the intermediary transfer belt 7 are transferred (secondary transfer) onto a sheet S of recording medium such as a sheet of recording paper by the function of the secondary transfer roller 8, to which the secondary transfer voltage (secondary transfer bias) is being applied, in the secondary transferring portion N2. For example, in an operation for forming a full-color image, the four layered toner images, different in color, on the intermediary transfer belt 7 are transferred together onto a sheet S of recording medium. A sheet S of recording medium is fed into the main assembly 9 of the image forming apparatus 10 from a storage 11 of a transferring medium supplying portion. Then, it is corrected in attitude in a registering-and-attitude-correcting portion 12. Then, it is conveyed to the secondary transferring portion N2.

After the transfer of the toner images onto a sheet S of recording medium, the sheet S is borne on a conveyance belt 13, which is an endless conveying member. Then, it is conveyed further. The conveyance belt 13 is driven by a driving motor (unshown) as a driving means. The image forming apparatus 10 is provided with a suction fan (unshown) for keeping a sheet S of recording medium adhered to the conveyance belt 13. The suction fan is disposed on the inward side of the loop which the conveyance belt 13 forms. Thereafter the sheet S is conveyed to a fixing apparatus 14, as a fixing means, which is disposed on the downstream side of the conveyance belt 13 in terms of the recording medium conveyance direction. Then, the sheet S is heated and pressed by the fixing apparatus 14. Consequently, the toner images become fixed to the sheet S. That is, a permanent full-color image is formed on the sheet S. Thereafter, the sheet S is conveyed to a transfer medium discharging portion, and then, is discharged into a delivery tray 15, which is outside the main assembly 9 of the image forming apparatus 10.

After the primary transfer, the adherent matters such as toner (primary transfer residual toner) which are remaining on the photosensitive drum 1Y are removed from the photosensitive drum 1Y by the belt cleaner 75, and then, are recovered. Further, the adherent matters such as toner (secondary transfer residual toner) which are remaining on the intermediary transfer belt 7 after the secondary transfer are removed from the intermediary transfer belt 7 by the belt cleaner 75 and are recovered.

The image forming apparatus 10 has a sensor unit 100, which is disposed on the downstream side of the primary transferring portion N1K, or the most downstream one, in terms of the direction in which a sheet S of recording medium is conveyed, in such a manner that it opposes the outward surface of the intermediary transfer belt 7, on the upstream side of the secondary transferring portion N2. The sensor unit 100 has registration sensors 102 and density sensors 103 (FIG. 2, for example), each of which is an optical sensor. The aforementioned backup roller 74 is disposed in a position which opposes the sensor unit 100 which is on the inward side of the loop which the intermediary transfer belt 7 forms. The sensor unit 100 will be described later in detail.

Further, the image forming apparatus 10 has the first and second intake fans 16 and 17, which are for generating airflow in the main assembly 9 (which hereafter may be referred to simply as apparatus main assembly 9) of the image forming apparatus 10, by drawing air into the apparatus main assembly 9 from outside the apparatus main assembly 9. The first intake fan 16 is attached to the left side wall of the casing 19 (main assembly casing) of the apparatus main assembly 9. It is by the first intake fan 16 that the air for cooling the image forming portions PY, PM, PC and PK, in particular, exposing apparatuses 3Y, 3M, 3C and 3K, is drawn into in their adjacencies, from the left side wall toward the right side wall. The second intake fan 17 is attached to the right side wall of the apparatus main assembly 9. It is by the second intake fan 17 that the airflow for cooling the interior (internal space) of the main assembly 9 of the image forming apparatus 10 is generated. It is by these airflows that the elements of each of the image forming portions PY, PM, PC and PK, except for those of each exposing apparatus, are prevented from excessively increasing in temperature.

Moreover, the image forming apparatus 10 has an exhaust fan 18 for exhausting air from within the apparatus main assembly 9 to generate airflow in the apparatus main assembly 9. The reason why temperature increases in the apparatus main assembly 9 is attributable to the fixing apparatus 14.

Therefore, the exhaust fan 18 is disposed above the fixing apparatus 14 in order to prevent the interior of the apparatus main assembly 9 from excessively increasing in temperature. The exhaust fan 18 is attached to the left side wall of the main assembly casing 19. It exhausts the internal air of the apparatus main assembly 9 rearward. As air is drawn into the apparatus main assembly 9 from outside the apparatus main assembly 9 by the second intake fan 17, it flows toward the exhaust fan 18.

[Controlling Portion]

Figure 2:
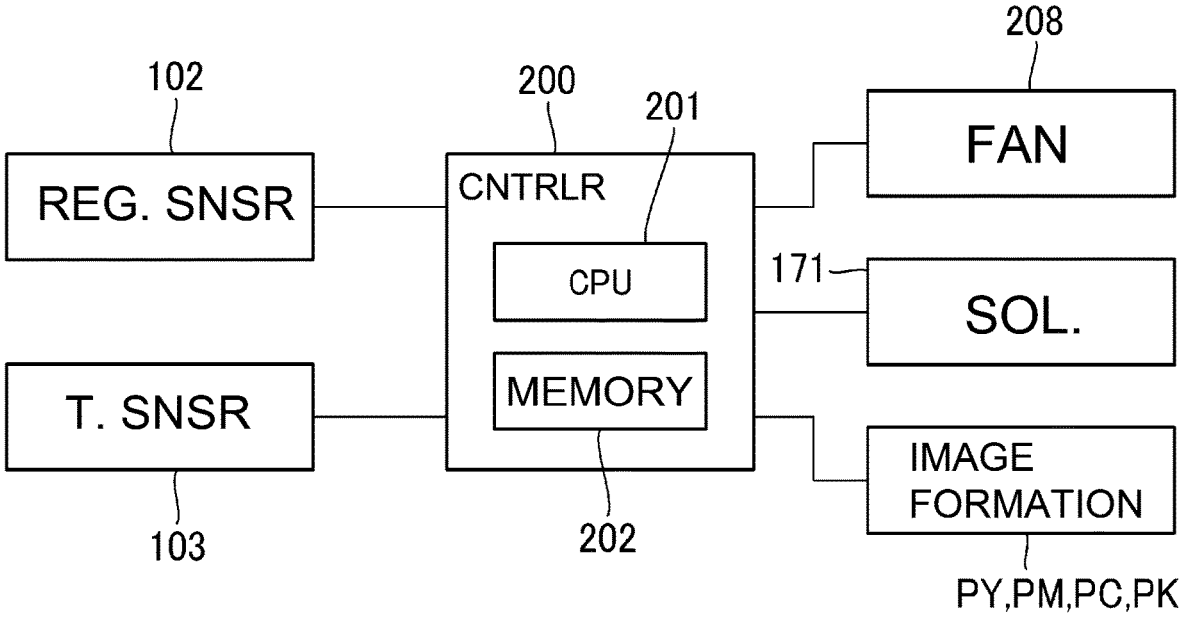
FIG. 2 is a block diagram of a part of the structure of the control portion of the image forming apparatus in this embodiment.

FIG. 2 shows the general structure of the controlling portion of the image forming apparatus 10 in this embodiment, which controls the essential portions of the image forming apparatus 10. The controlling portion 200, as a controlling means, with which the image forming apparatus 10 is provided, comprises: a CPU 201 which is the principal element for computation; and memories such as a ROM and a RAM, each of which is a storage element. In the RAM, the results of detection by the sensors, results of computation, etc., are stored. In the ROM, control programs, pre-obtained data tables, or the like, are stored. In this embodiment, the controlling portion 200 integrally controls each of various portions of the image forming apparatus 10. In this embodiment, the controlling portion 200 corrects the image forming portions PY, PM, PC and PK based on the results of the detection by the registration sensors 102 and density sensors 103, to adjust the image forming apparatus 10 in the point at which each of the monochromatic images which are different in color begins to be written, and also, in image density. Further, the controlling portion 200 controls the driving of the solenoid 171 for opening or closing the shutter of the sensor unit 100, as will be described later in detail.

[Sensor Unit]

Next, the sensor unit 100 is described. First, referring to FIG. 3, the overall structure and operation of the sensor unit 100 are described. Roughly speaking, the sensor unit 100 is dividable into a casing 110, registration sensors 102, density sensors 103, a sensor holder 211, an anti-soiling fan 208, and a duct 220. The casing 110, as a supporting portion, functions as the external frame for the sensor unit 100. The multiple sensors, more specifically, the registration sensors 102 and density sensors 103 detect the registration patches and density patches, as objects to be detected, on the surface of the intermediary transfer belt 7 as a moving member. The sensor holder 211, as a holding portion, is supported by the casing 110. It holds the registration sensors 102 and density sensors 103. The fan 208, as an airflow generating means, is fixed (attached) to the casing 110. The duct 220 is held to the upstream side of sensor holder 211, in terms of the direction parallel to the rotational direction of the intermediary transfer belt 7. It sends the air discharged from the fan 208, to the registration sensors 102 and density sensors 103. Next, each of the various portions of the sensor unit is described in detail.

[Casing]

Figure 3:
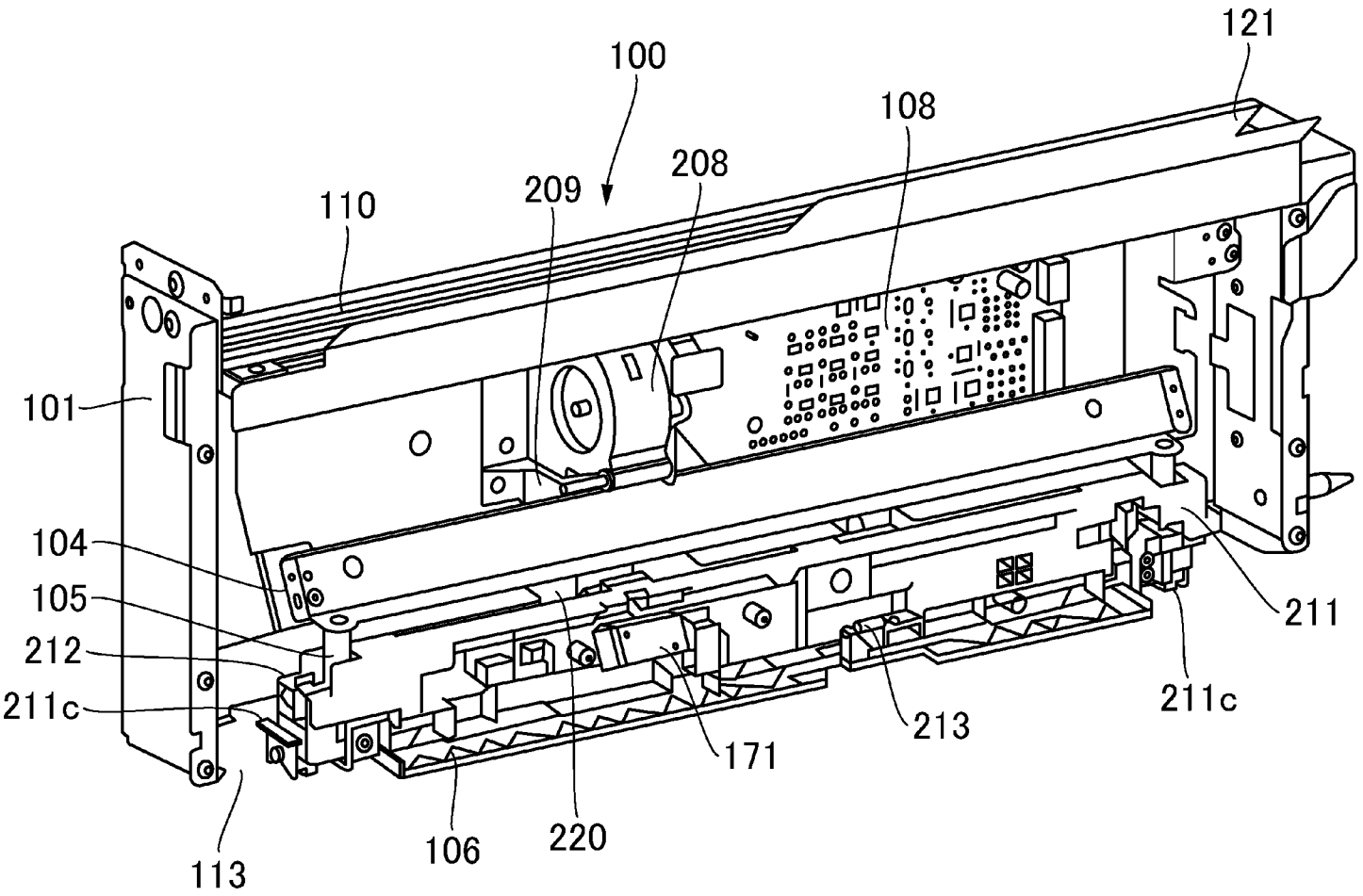
FIG. 3 is an internal perspective view of the sensor unit in this embodiment.
Figure 4:
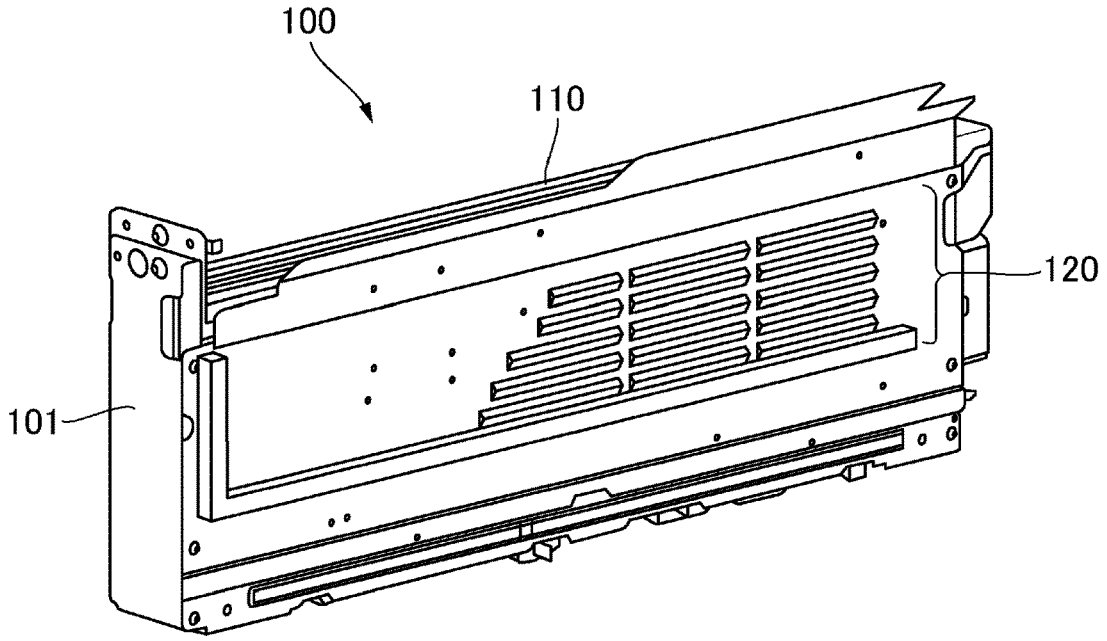
FIG. 4 is an external perspective view of the sensor unit in this embodiment.

Referring to FIGS. 3 and 4, the casing 110 is in the form of a long-and-narrow rectangular parallelepiped. It is disposed so that its long edges are roughly perpendicular to the widthwise direction of the intermediary transfer belt 7. A frame 101 by which the sensor unit 100 is fixed to the image forming apparatus 100 is the base portion of the casing 110. Referring to FIG. 3, the sensor unit 100 is provided with a sensor holder supporting plate 104, an electrical circuit 108, a fan 208, etc., which are fixed to the inward surface (left surface of casing 110, within supporting portion). The sensor holder supporting plate 104 supports the sensor holder 21. The electrical circuit 108 processes the electrical signals which are to be sent to the registration sensors 102, density sensors 103, and the solenoid 171 for opening or closing the shutter. The fan 208 is a soiling prevention fan, which is employed as a mechanism for preventing sensors from being soiled, which will be described later.

Next, referring to FIG. 4, the casing 110 is provided with air induction openings 120, through which the air, which is flowing within the main assembly 9 of the image forming apparatus 10, is drawn into the casing 110. Referring to FIG. 3, the bottom wall of the casing 110 is provided with detection openings 113, through which the detection surface of each registration sensor 102, and that of each density sensor 103, are exposed to the intermediary transfer belt 7.

Figure 5:
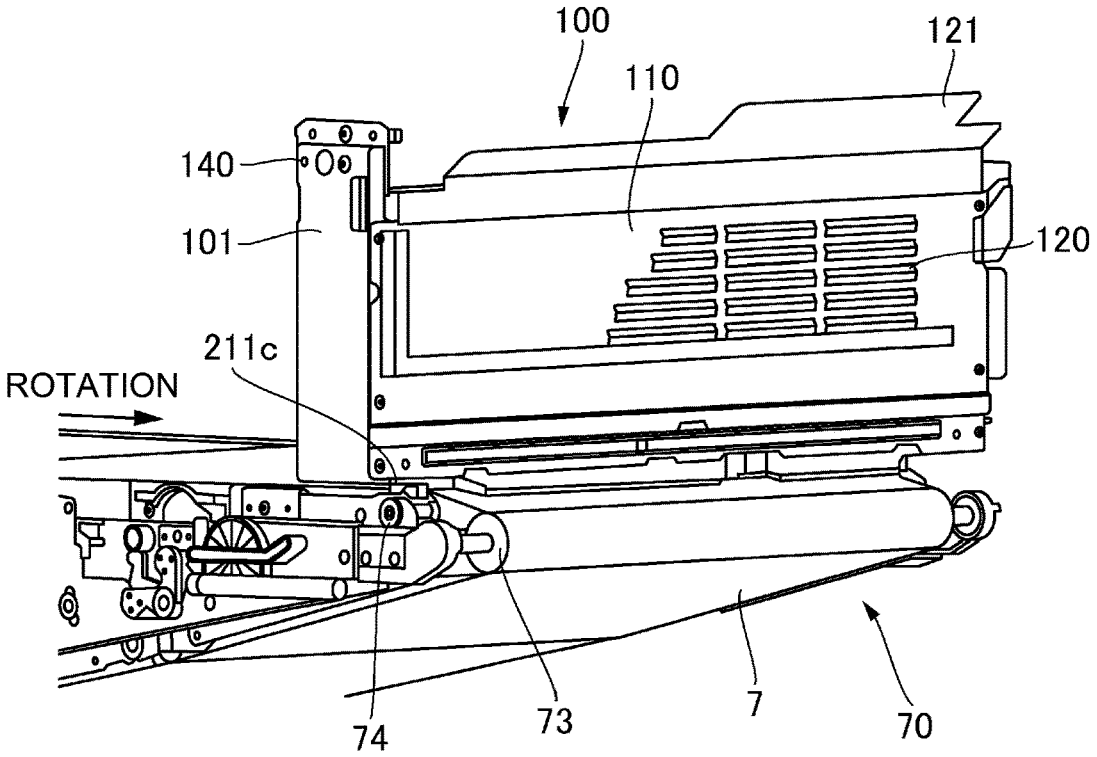
FIG. 5 is a perspective view of a combination of the sensor unit and belt unit in this embodiment.

Next, referring to FIG. 5, the sensor unit 100 and image forming apparatus 10 are structured so that the former is removably installable in the main assembly 9 of the latter. As the sensor unit 100 is inserted into the apparatus main assembly 9, a positioning portion 140, with which the frame 101 of the casing 110 of the sensor unit 100 is provided, fits into an unshown portion, with which the frame of the main assembly 9 of the image forming apparatus 10 is provided, whereby the sensor unit 100 becomes fixed to the apparatus main assembly 9. During this process, the sensor unit 100 is positioned so that it opposes the surface of the intermediary transfer belt 7.

[Sensors]

The multiple sensors, more specifically, the registration sensors 102 and density sensors 103, are such sensors that detect a toner image on the surface of the intermediary transfer belt 7, which is the object of detection. Each of the registration sensor 102 and density sensor 103 has the detection surface 112 (FIG. 14, for example, which will be described later) which faces the surface of the intermediary transfer belt 7. Each registration sensor 102 is an optical sensor for reading a referential image (which hereafter may be referred to as registration-patch), which is a toner image formed on the intermediary transfer belt 7 to correct the image forming apparatus in color deviation. Each density sensor 103 is an optical sensor for reading the referential image (which hereafter may be referred to as density patch), which is a toner image formed on the intermediary transfer belt 7 to correct the image forming apparatus in image density.

Figure 6:
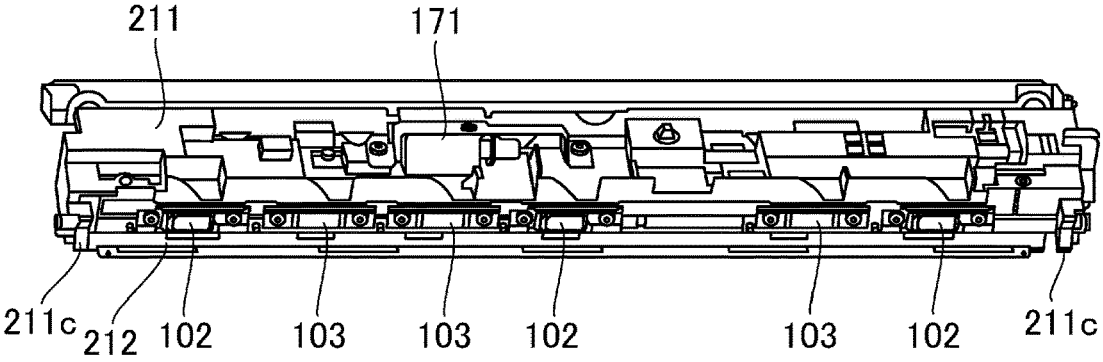
FIG. 6 is a perspective view of the sensor holder in this embodiment.

Referring to FIG. 6, the sensor unit 100 is provided with three registration sensors 102, which are in alignment in the widthwise direction of the intermediary transfer belt 7. It is based on the results of detection of yellow, magenta, and cyan registration patches by these sensors 102 that the amount of color deviation is calculated for each color. Here, the amounts of deviation include the deviation in the position at which an electrostatic latent image begins to be written for each color, in terms of the direction in which the intermediary transfer belt 7 is conveyed, and also, in terms of the widthwise direction of the intermediary transfer belt 7, the angular deviation of each of the toner images, different in color, relative to the referential direction, and the deviation in the magnification (scale) of each of the toner images, different in color. Each of the calculated amounts of deviation, is processed by the controlling portion 200 (FIG. 2), and is fed back to the image forming operation.

Also referring to FIG. 6, the sensor unit 100 is provided with three density sensors 103, which are aligned in the widthwise direction of the intermediary transfer belt 7. It is based on the results of detection of yellow, magenta, cyan and black density patches by these sensors 103 that the amount of deviation in density is calculated for each color. Each of the calculated amounts of deviation in density is processed by the controlling portion 200 (FIG. 2), and is fed back to the controlling of each image forming portion. By the way, in this embodiment, the sensor unit 100 is provided with multiple registration sensors 102 and density sensors 103. However, this embodiment is not intended to limit the present invention in scope in terms of the number of the registration sensors 102 and that of the density sensors 103.

[Sensor Holder]

Referring to FIG. 6, the sensor holder 211 holds the registration sensors 102 and density sensors 103. A sensor holder such as the sensor holder 211 is movably supported relative to the casing 110. More concretely, referring to FIG. 3, the sensor holder supporting plate 104 is fixed to the casing 110, and the sensor holder 211 is supported by the sensor holder supporting plate 104, with the placement of a pair of supporting springs 105, as elastic members, between the sensor holder supporting plate 104 and sensor holder 211. Thus, the sensor holder 211 is allowed to move in the direction which is perpendicular to the surface of the intermediary transfer belt 7 (height direction of image forming apparatus 10).

Further, the sensor unit 100 is provided with a pair of sensor positioning portions 211*c*, which are positioned at the front and rear ends of the sensor unit 100, one for one. As the sensor unit 100 is inserted into the apparatus main assembly 9, the sensor positioning portions 211*c* are made to come into contact with unshown sensor positioning portions, with which the belt unit 70 is provided, by the pressure from the support springs 105. Therefore, the distance between the registration sensors 102 and density sensors 103, which are held by the sensor holder 211, and the surface of the intermediary transfer belt 7, remains stable at a preset value.

The stopper portions are parts of the axle of the backup roller 74 which is on the inward side of the loop the intermediary transfer belt 7 forms. Each stopper portion is a bearing, for example, by which the backup roller 74 is rotatably supported. That is, the axle of the backup roller 74 is provided with the pair of stopper portions, in order to prevent the intermediary transfer belt 7 from laterally deviating in position. With the provision of this structural arrangement, the sensors remain stable in performance. In this embodiment, it is the axle of the backup roller 74 that is provided with the stopper portions for preventing the lateral deviation of the intermediary transfer belt 7. However, this embodiment is not intended to limit the present invention in scope in terms of the choice of the stopper portion. That is, it may be a pair of supporting members such as a pair of metallic plates.

Further, the sensor holder 211 is provided with the shuttering member 106, and the solenoid for opening or closing the shuttering member 106.

[Shutter]

Figure 7:
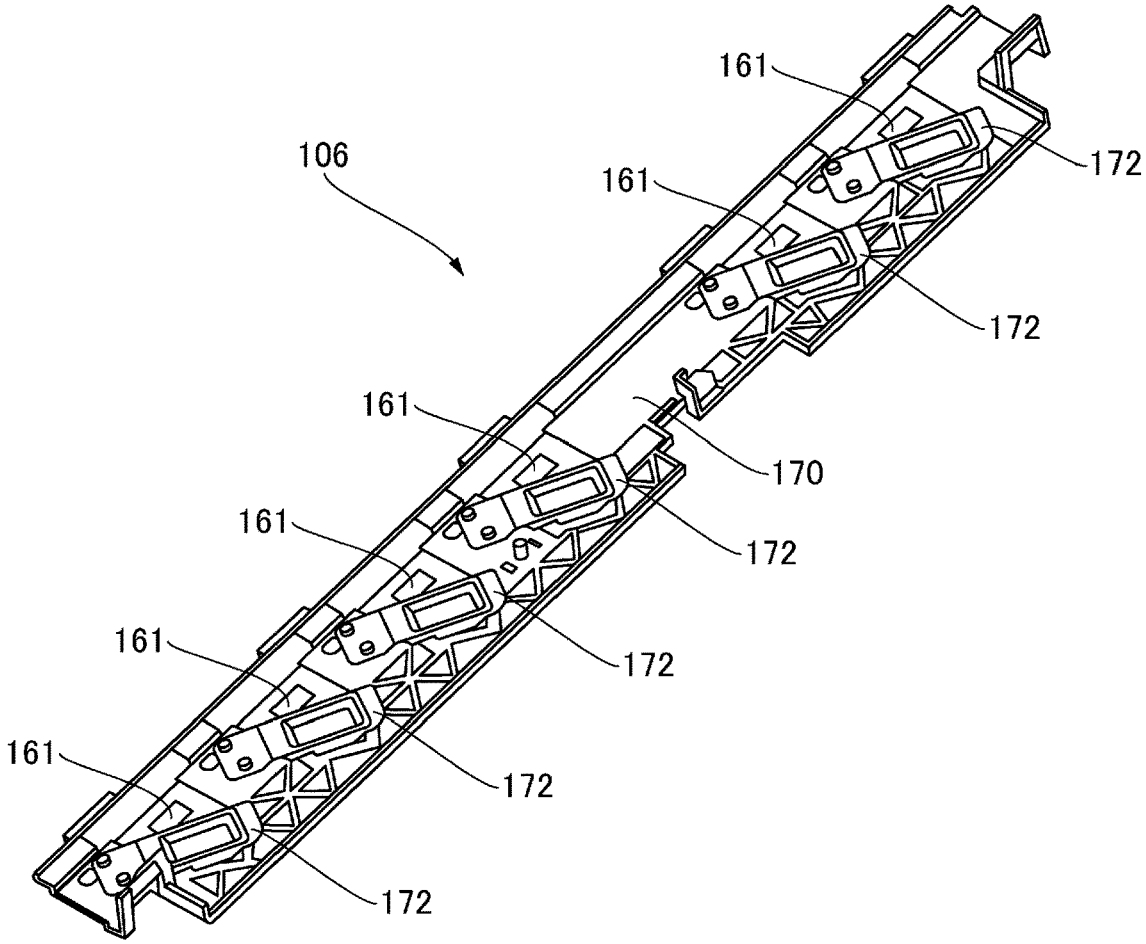
FIG. 7 is a perspective view of the shutter in this embodiment.

Next, referring to FIGS. 7-9(*b*), the shuttering member 106 is described. The shuttering member 106 is supported by the sensor holder 211, being thereby positioned between the detection surface of each registration sensor 102 and the surface of the intermediary transfer belt 7, and also, between each density sensor 103 and the surface of the intermediary transfer belt 7. By the way, the shuttering member 106 may be supported by the casing 110. The shuttering member 106 is movable to a position (which hereafter may be referred to as the open position) in which the detection surfaces 112 are exposed to the surface of the intermediary transfer belt 7, and a position (which hereafter may be referred to as the closed position), in which the shuttering member 106 blocks the detection surfaces 112 from the surface of the intermediary transfer belt 7. The shuttering member 106 is moved by the solenoid 171 as a shutter driving portion.

Referring to FIG. 7, the shuttering member 106 has a linking member 170 and multiple rotational shutters 172. The linking member 170 is a roughly rectangular piece of plate. It is disposed so that its lengthwise direction is parallel to the widthwise direction of the intermediary transfer belt 7. The rotational shutters 172 are positioned so that each rotational shutter 172 opposes corresponding registration sensor 102 or density sensor 103. Each rotational shutter 172 rotates about a part of the linking member 170.

The linking member 170, as a moving member, is attached to the sensor holder 211 in such a manner that it can be slid in the direction parallel to the widthwise direction of the intermediary transfer belt 7. It has openings 161 through which the detection surface 112 of each of the registration sensors 102 and density sensors 103 can be exposed to the surface of the intermediary transfer belt 7. That is, as the linking member 170 is moved to its open position, each opening 161 of the linking member 170 opposes the corresponding detection surface 112, whereas as the linking member 170 is moved into the closed position, each opening 161 is displaced from the position in which it opposes the corresponding detection surface 112.

Each rotational shutter 172, as a covering member, is moved by the movement of the linking member 170, to an open position, in which it is away from the corresponding opening 161, and a closed position in which it keeps the opening 161 covered. In this embodiment, each rotational shutter 172 is rotatably supported by the linking member 170. It is rotated by the sliding of the linking member 170.

At this point in time, the state of shuttering member 106, in which the shuttering member 106 remains open, and that in which the shuttering member 106 remains closed, are concretely described. First, the state (closed state) of the shuttering member 106, in which the shuttering member 106 is in its closed position, is described. Referring to part (a) and part (b) of FIG. 8, as the solenoid 171 is turned off (driving of shutter driving portion is stopped), the linking member 170 is made to slide rearward of the apparatus main assembly 9 by the resiliency of a tension spring 213, as a pressuring member. Further, the rotational shutter 172 is rotated by the sliding movement of the linking member 170, about a part of the linking member 170. Consequently, not only each opening 161 of the linking member 170 no longer opposes the corresponding detection surface of registration sensor 102, or that of the density sensor 103, but also, each rotational shutter 172 covers the corresponding detection surface 112 of the registration sensor 102, or that of the density sensor 103 (closed state). Therefore, it is possible to prevent toner from adhering to the detection surface 112 of the registration sensor 102 and that of the density sensor 103.

Next, the state of the shuttering member 106, in which it is in its open position (open state), is described. Referring to part (a) and part (b) of FIG. 9, as the solenoid 171 is turned on (shutter driving portion is driven), the linking member 170 slides frontward of the apparatus main assembly 9 against the resiliency of the tension spring 213. Thus, each rotational shutter 172 is rotationally moved by the sliding movement of the linking member 170, about the part of the linking member 170. Consequently, not only does each opening 161 of the linking member 170 oppose the corresponding detection surface 112 of the registration sensor 102, or that of the density sensor 103, but also, each rotational shutter 172 is moved into a position in which it does not cover the corresponding detection surface 112 of the registration sensor 102, or that of the density sensor 103. Therefore, the detection surface 112 of each registration sensor 102 and that of each density sensor 103 oppose the surface of the intermediary transfer belt 7 (open state). Further, it becomes possible to detect the toner images on the intermediary transfer belt 7 by the registration sensors 102 and density sensors 103.

[Soiling of detection surface of sensor]

Next, referring to part (a) to part (f) of FIG. 10, and part 11(*a*) to part 11(*f*) of FIG. 11, the effects of the soiling of the detection surface 112 of the registration sensor 102 and that of the density sensor 103 are described. As the detection surface 112 of the registration sensor 102 and that of the density sensor 103 are exposed to the toner which scattered from the toner images on the intermediary transfer belt 7, for example, they become soiled. As the detection surfaces 112 are soiled, the sensor unit 100 reduces in accuracy.

First, referring to part (a) to part (f) of FIG. 10, the effects of the soiling of the detection surface 112 of the registration sensor 102 are described. Part (a) to part (c) of FIG. 10 shows show the relationship between the registration patches and sensor outputs, when the detection surface 112 of the registration sensor 102 and that of the density sensor 103 are unsoiled (clean). Part (d) to part (f) of FIG. 10 show the relationship between the registration patches and sensor outputs, when the detection surface 112 is soiled (dirty). The registration patches in part (a) of FIG. 10 are the same as those in part (d) of FIG. 10.

When the detection surface 112 of the registration sensor 102 is unsoiled, the waveform of the analog output of the registration sensor 102 looks as shown in part (b) of FIG. 10. This drawing shows the results of the reading of the registration patch by the optical sensor as the registration sensor 102 which detects the diffusely reflected light. The optical sensor for detecting diffusively reflected light is relatively small in output when the object of detection is black (K). Therefore, the colored patches are sandwiched by the black patches to even the outputs. As the analog output of each optical sensor, which has the waveform shown in part (b) of FIG. 10, is digitized, a waveform shown in part (c) of FIG. 10, is obtained.

The amount of color deviation for each color patch is obtained based on the difference between the amount by which light is reflected by the intermediary transfer belt 7 and that by each patch, which are detected by the registration sensor 102. It is based on these differences that the amount by which the exposing apparatuses are to be adjusted in the position at which an electrostatic latent image begins to be written, is calculated by the controlling portion 200. If the detection surface 112 of the registration sensor 102 is soiled, the waveform of the analog outputs read by the registration sensor 102 looks as shown in part (e) of FIG. 10.

As the detection surface 112 of the registration sensor 102 becomes soiled, not only does the amount of difference between the amount by which light is reflected by the surface of the intermediary transfer belt 7, and that by each patch, reduce, but also, the edge of each patch becomes blurry. Therefore, if the outputs, the waveform of which looks as shown in part (e) of FIG. 10, are digitalized, the waveform of the output becomes as shown in part (f) of FIG. 10. It is evident from the comparison between part (f) of FIG. 10 and part (c) of FIG. 10 that as the detection surface 112 of the registration sensor 102 becomes soiled, it sometimes occurs that it becomes difficult for the controlling portion 200 to pinpoint the center of each patch, and/or the registration sensor 102 erroneously reads the patches. If the controlling portion 200 fails to pinpoint the center of each patch, and/or erroneously read the patches, the actual amount of positional deviation of each patch, becomes different from the measured amount of difference, making it impossible for the controlling portion 200 to properly adjust each exposing apparatus in the position at which each exposing apparatus is to begin writing an electrostatic latent image. Consequently, the color deviation occurs.

Next, referring to part (a) of FIG. 11 to part (f) of FIG. 11, the effects of the soiling of the detection surface 112 of the density sensor 103 are described. Part (a) of FIG. 11 to part (c) of FIG. 11 show the density patches and the outputs of the density sensor 103 when the detection surface 112 of the density sensor 103 is unsoiled. Part (d) of FIG. 11 to part (f) of FIG. 11 show the relationship between the density patches and the outputs of the density sensor 103 and amount of LED light, when the detection surface 112 of the density sensor 103 is soiled. The density patches in part (a) of FIG. 10 and the density patches in part (d) of FIG. 11 are the same.

When the detection surface 112 of the density sensor 103 is clean, the waveform of the analog outputs of the density sensor 103 looks as shown in part (b) of FIG. 11. In order to control the image forming apparatus 10 in image density, a referential level of density has to be set. For example, this referential level of density is obtained by reading the density of a density reference member with which the shuttering member 106 is provided, and which is correspondent in position to the density sensor 103, and making adjustments so that the density sensor 103 provides a preset amount of output.

Referring to part (c) and part (f) of FIG. 10, the density sensor 103 can be adjusted in output by adjusting the amount by which electrical current is supplied to the LED as the light source, or the like measure. Then, the image forming apparatus 10 is adjusted in image density based on the referential level of density described above, and the read level of density of the patch. That is, the amount of difference between the amount by which light is reflected by the referential density member, and the amount by which light is reflected by each patch is measured by the density sensor 103. Then, image density of each patch is measured with reference to this difference. Then, the amount by which the image forming apparatus 10 is to be adjusted in image density is calculated by the controlling portion 200, based on this measured amount of difference.

However, if the detection surface 112 of the density sensor 103 is soiled after the setting of the referential density level, the waveform of the output of the density sensor 103 becomes as shown in part (e) of FIG. 11, being different in level from the one before the detection surface 112 of the density sensor 103 is soiled. That is, as will be evident from the comparison between part (e) of FIG. 11 and part (b) of FIG. 11, even though the density patch read after the soiling of the detection surface 112 of the density sensor 103 is the same as the one read before the soiling, the output of the density sensor 103 after the soiling is different from the one before the soiling. Thus, the controlling portion 200 erroneously controls the image forming apparatus 10 in image density. Issues similar to this one also occur if the density reference member is soiled before the referential level of density is set, the detection surface 112 of the density sensor 103 is dirty, and/or both the density reference member and the detection surface 112 of the density sensor 103 are soiled.

[Soiling prevention by airflow]

In this embodiment, therefore, airflow is used to prevent the problem that toner or the like soiling causing matters adhere to the detection surface 112 of the registration sensor 102 and that of the density sensor 103. That is, the image forming apparatus 10 is structured so that the airflow is generated by a soiling prevention fan 208 disposed in the sensor unit 100, and is guided by a duct 220, shown in FIGS. 12-14, etc., to cause the airflow to flow along the detection surface 112 and blow out through the openings 161, in order to prevent toner and/or the like from adhering to the detection surface 112. In this embodiment, the duct 220 is disposed so that the air sent to the space between the detection surface 112 and the surface of the intermediary transfer belt 7 flows in the same direction as the rotational direction (preset direction) of the intermediary transfer belt 7. Next, the airflow is described as it is observed from the front side of the apparatus main assembly 9, and also, as it is observed from the direction which is perpendicular to the rotational direction of the intermediary transfer belt 7.

[Airflow as seen from front side of main assembly of image forming apparatus]

Next, referring to FIG. 12, the duct 220 is described. To begin with, airflow is generated in the main assembly 9 of the image forming apparatus 10. The right side wall of the frame 101 within the sensor unit 100 is provided with an intake opening 120, which is an opening for taking air into the casing 110. In terms of the airflow generated by the second intake fan 17, the intake opening 120 is disposed on the downstream side of the second intake fan 17, to allow the airflow to be guided into the casing 110 by a stator 121.

Referring to FIG. 13, the fan 208, with which the casing 110 is provided, takes air into the casing 110 through the intake opening 120. Then, the air from the fan 208 is sent to the registration sensor 102 and density sensor 103 through the duct 220. In the case of this structural arrangement, the fan 208 is disposed slightly frontward of the center of the sensor unit 100. Further, the duct 220 is disposed on the upstream side of the registration sensor 102 and density sensor 103 in terms of the direction parallel to the rotational direction of the intermediary transfer belt 7. Further, the sensor unit 100 is provided with an exhaust opening 205*a*, which faces the space between the detection surface 112 and the surface of the intermediary transfer belt 7. Therefore, the air sent through the duct 220 flows in the direction parallel to the rotational direction (preset direction) of the intermediary transfer belt 7, along the surface of the intermediary transfer belt 7. As described above, the sensor unit 100 is structured so that the direction in which air is discharged from the duct 220 is the same as the rotational direction of the intermediary transfer belt 7. Therefore, it is prevented that the toner images on the intermediary transfer belt 7 are disturbed by the air discharged from the duct 220.

The duct 220 has a relay duct 209 as the first duct portion, and a second duct 212 as the second duct portion. The relay duct 209 is directly supported by the casing 110. It is in connection to the exhaust opening 208*a* of the fan 208 by its intake opening 209*a*. The sensor duct 212 is supported by the sensor holder 211. It has: an intake portion 204 which is in connection to the relay duct 209 in such a manner that it is movable relative to the relay duct 209; multiple branch portions 203 which extend from the intake portion 204; multiple exhaust portions 205, and stator 206, as shown in FIG. 16, etc., which will be described later.

As air is discharged by the fan 208, it is guided to the intake portion 204 of the sensor duct 212, through the relay duct 209. The intake portion 204 has an intake opening 204*a* which is in connection to the exhaust opening 209*b* of the relay duct 209. Therefore, the intake opening 204*a* takes in the air from the fan 208. As the air flows into the intake opening 204*a*, the intake opening 204*a* sends the air to the multiple branch portions 203 of the duct 209, which are greater in number than the intake opening 204*a*. As a body of air enters the branch portions 203 of the duct 209, the branch portions 203 separate the body of air into multiple smaller bodies of air, and sends them to the registration sensors 102 and density sensors 103, which are the same in number (six in all in this embodiment) as that of the branch portions 203.

As air is sent to the branch portions 203 of the sensor duct 212, it is sent to the space between the detection surface 112 of the registration sensor 102, and the intermediary transfer belt 7, and the space between the detection surface 112 of the density sensor 103, and the surface of the intermediary transfer belt 7 as shown in FIG. 14. That is, as air is guided into the sensor duct 212, it is divisively sent to a total of six portions, which correspond to the registration sensors 102 and density sensors 103, by the multiple branch portions 203. Then, the air in each branch portion 203 of the sensor duct 212 advances to the corresponding exhaust opening 205*a*.

As the air comes out of the exhaust opening 205*a*, it flows along the detection surface 112 of each sensor, and flows to the opening 161 of the shuttering member 106 which is in the state of being open. Then, it flows toward the intermediary transfer belt 7 (movable member) through the opening 161. Therefore, it is possible to prevent the problem that the toner which scattered from the surface of the intermediary transfer belt 7 enters the sensor unit 100. Therefore, it is possible to prevent the detection surface 112 from being soiled by the toner from the intermediary transfer belt 7. By the way, the sensor duct 212 will be described later in detail.

In this embodiment, the sensor duct 212 held by the sensor holder 211 is variable in attitude relative to the fan 208 fixed to the casing 110, and also, relative to the relay duct 209. That is, as described above, the sensor holder 211 is held to the casing 110, with the placement of the support springs 105 between itself and the casing 110, being therefore movable relative to each other. Therefore, the joint between the relay duct 209 and sensor duct 212 is sealed with a sealing sheet 210.

[Airflow as seen from rotational direction of intermediary transfer belt]

Next, the airflow as seen from the direction which is perpendicular to the rotational direction of the intermediary transfer belt 7 is described. As described above, air taken into the sensor unit 100 through the intake opening 120 of the right side wall of the frame 101 of the sensor unit 100 is drawn by a soiling prevention fan 208 held by the frame 101, and is discharged toward the relay duct 209. Then, the air discharged from the fan 208 advances to the intake opening 204*a* through the relay duct 209, enters the sensor duct 212, and is distributed into the six branch portions 203 of the sensor duct 212, shown in FIG. 16. As the air comes out of the exhaust opening 205*a* of the sensor duct 203, it blows onto the surface of the intermediary transfer belt 7 through the opening 161 which opposes the detection surface 112 (FIG. 14).

Next, referring to FIGS. 15 to 19, the sensor duct 212 having multiple branch portions 202 is described. By the way, FIGS. 15, 17(*a*), and 17(*b*) are sectional views of the sensor duct 212*a* of the comparative sensor unit as seen from the rotational direction of the intermediary transfer belt 7. FIGS. 16, 18(*a*), and 18(*b*) are drawings (sectional views) of the sensor duct 212 in this embodiment as seen from the rotational direction of the intermediary transfer belt 7. FIG. 19 is an enlarged view of the left portion (part of sensor duct 212) of part (a) of FIG. 18.

Further, FIGS. 15 and 16 are sectional views of the sensor ducts 212*a* and 212, respectively, as seen from the downstream side in terms of the rotational direction of the intermediary transfer belt 7. Part (a) and part (b) of FIG. 17 are sectional views of the sensor ducts 212*a* and 212, respectively, as seen from the upstream side in terms of the rotational direction of the intermediary transfer belt 7. In FIGS. 17 and 18, the airflow is indicated by an arrow mark.

Further, as the sensor ducts 212 and 212*a* are fixed to the sensor holder 211, they are blocked by a wall portion 211*a*, which is a part of the sensor holder 211, at its right side with reference to FIG. 13. That is, the intake portion 204, and the lateral opening of each of the multiple branch portions 203, are blocked by the wall portion 211*a*. In the case of the illustrated sensor unit 100, a sheet 211*b* is provided between the wall portion 211*a* and sensor duct 212, and this sheet 211*b* is extended to a point which is outside the exhaust opening 209*b* of the relay duct 209. This embodiment, however, is not intended to limit the present invention in the structure of this portion. For example, this portion may be structured so that the openings of the side wall of the intake portion 204, and those of the multiple branch portions 203, are blocked before the sensor ducts 212 and 212A are fixed to the sensor holder 211.

[Sensor Duct of Comparative Sensor Unit]

A sensor unit, the duct of which has multiple branch portions, suffers from the following problem. This problem is described with reference to the comparative sensor unit shown in FIGS. 15, 17(*a*) and 17(*b*). Referring to FIG. 15, unlike the sensor duct 212 (FIG. 16) in this embodiment, the sensor duct 212*a* of this comparative sensor unit is not provided with rectifier plates 206, which will be described later.

Referring to part (a) of FIG. 17, which shows the direction of the airflow through the intake opening 204*a*, in the case of the branch portion 203, which squarely faces the intake opening 204*a*, the drawn air advances straight while spreading. In comparison, in the case of a branch portion 203 which is offset from the center of the intermediary transfer belt 7 in terms of its widthwise direction, for example, the branch portion 203 in a section A in part (a) of FIG. 17, as air is discharged from the exhaust opening 205*a* of this branch portion 203, the air continues to advance at the same angle as the angle at which it comes out of the exhaust opening 205*a*. Therefore, it fails to reach across the entirety of the detection surface 112 of the sensor. In particular, in the adjacencies of the intake opening 204*a* (section C in part (b) of FIG. 17) is insufficient in the amount of airflow. That is, the detection surface 112 of the sensor in the adjacencies of the exhaust opening 205*a* is unsatisfactory in the direction and amount of airflow. Therefore, the air fails to satisfactorily blow back toner particles as the toner particles come through the opening 161, making it possible for the detection surface 112 to be soiled.

For example, if the sensor unit 100 is increased in the distance from the bend of branch portion 203 to the exhaust opening 205*a*, the air advances while gradually spreading at an angle which is similar to the angle of the surface of the wall of the downstream portion of the branch portion 203, relative to the bend, in terms of the direction of the airflow. However, structuring the sensor unit 100 in this manner increases the unit in size and loss cost, making it difficult to provide the detection surface 112 with a satisfactory amount of airflow. It is possible to narrow the exhaust opening 205*a* in order to force air to advance straight to the opening 161. This method, however, makes it difficult to make the airflow wide enough to match the width of each sensor.

Sensor Duct in this Embodiment

In this embodiment, therefore, in order to prevent the detection surface 112 of each sensor from being soiled, a rectifier plate 206 is disposed in the adjacencies of the exhaust opening 205*a* to make air to flow in the desired direction, and also, to make the airflow to desirably spread across the detection surface 112. Referring to FIGS. 16, 18(*a*), 18(*b*) and 19, the sensor duct 212 in this embodiment has an intake portion 204, a duct with multiple branch portions 203, exhaust portions 205, and rectifier plates 206.

As described above, the intake portion 204 is provided with the intake opening 204*a*, through which air is taken in from the fan 208 by way of the relay duct 209. The multiple branch portions 203 are greater in number than the intake opening 204*a*. Thus, as a body of air enters sensor duct 212 through the intake opening 204*a*, the multiple branch portions 203 divide the body of air into the same number of smaller bodies of air as the number of the registration sensors 102 and density sensors 103, and send the smaller bodies of air to the registration sensors 102 and density sensors 103, one for one.

Further, each of the multiple branch portions 203 is provided with its own exhaust portion 205, which is provided with the exhaust opening 205*a*, through which the air is discharged after being moved through the branch portion 203. Each exhaust opening 205*a* is aimed toward the detection surface 112 of the corresponding sensor. That is, the exhaust portion 205 is shaped in such a manner that its air passage substantially curves across its downstream portion in terms of the direction in which air flows in the branch portions 203. That is, each branch portion 203 has: the first portion 203A, which is the upstream portion of the branch portion 203 in terms of the exhaust direction, and the second portion 203B, which is in connection to the downstream end of the first portion 203A. The second portion 203B is different from the first portion 203A in the exhaust direction. Therefore, unless the sensor unit 100 is provided with the rectifier plates 206, which will be described next, most of the air which came through the branch portion 203 collides with the opposite inside wall of the exhaust portion 205, from the intake portion 204, and is changed in direction by the wall, as shown in part (a) of FIG. 17 which shows the exhaust portion of the comparative sensor unit. Then, it is discharged through the exhaust opening 205*a* in such a manner that the opposite portion of the branch portion 203 from the intake portion 204 becomes greater in the amount of airflow.

Further, among the inner walls of the exhaust portion 205, the inner wall 205*b*, which is the opposite inner wall from the detection surface 112 of the corresponding sensor is slanted in a manner to guide air to the detection surface 112 as air flows to the exhaust portion 205. That is, referring to FIG. 14, the inside wall 205*b* is tilted so that the more downstream it is in terms of the airflow direction, the smaller the distance is between itself and the registration sensor 102 (or density sensor 103).

Each rectifier plate 206, as an air-guiding portion (guiding portion), is disposed inside at least one of the multiple exhaust portions 205. In this embodiment, the exhaust portion 205 of each branch portion 203, except for the closest exhaust portion 205 of the branch portion 2 to the intake opening 204*a*, is provided with the rectifier plate 206. That is, in this embodiment, the sensor unit 100 is provided with multiple rectifier plates 206. However, the number of the rectifier plates 206 is smaller than that of the multiple exhaust portion 205. By the way, the sensor unit 100 may be structured so that all the exhaust portions 205 are provided with the rectifier plate 206, or only the farthest exhaust portion 205 from the intake opening 204*a*, or the farthest and second farthest exhaust portions 205 from the intake opening 204*a* (left and right exhaust portions 205, for example, in FIG. 16). That is, which exhaust portion 205 is to be provided with the rectifier plate 206 is optional.

Further, in this embodiment, each rectifier plate 206 is attached to the outwardly extended portion of the opposite inside wall 207 of the branch portion 203 from the intake portion 204, in such a manner that it is intersectional to the extended portion. Further, the rectifier plate 206 is disposed roughly perpendicular to the wall having the exhaust opening 205*a*. In this embodiment, the sensor unit 100 is structured so that the rectifier plate 206 roughly perpendicularly protrudes from the inside wall 205*b* of the exhaust portion 205, toward the opposite wall from the inside wall 205*b*. The rectifier plate 206 changes a part of the airflow in the branch portion 203, in direction.

That is, referring to part (a) of FIG. 18, as air is drawn into the sensor unit 100 through the intake opening 204*a*, the drawn air advances straight and collides with one of the inside walls 207 of the branch portion 203, and advances further along the inside wall 207 of the branch portion 203. Next, referring to FIG. 19, the rectifier plate 206, which is for changing in direction, this air which is following the inside wall 207, is disposed in such a manner that it coincides with the theoretical extension (broken line) of the inside wall 207. In other words, not only is the rectifier plate 206 disposed within the second portion 203B, but also, it is intersectional to the theoretical extension of the inside wall 207, that is, one of the inside walls of the first portion 203A of the branch portion 203 of the sensor duct. It causes the air in the second portion 203B of the branch portion 203 to separate into two bodies of air, while guiding the air toward the exhaust opening 205*a*. Therefore, as the air in the branch portion 203 collides with the rectifier plate 206, a part of the body of air, that is, the part of the body of air, which is caused to flow next to the inside wall 207 (closer to intake portion 204), is changed in direction, whereby it is ensured that a proper (preset) amount of air is discharged from the exhaust opening 205*a*. Therefore, it is ensured that the portion of the exhaust opening 205*a*, which is closer to the intake opening 204*a*, is also sufficiently provided with air which flows toward the opening 161 from the exhaust opening 205*a*. Therefore, it is possible to prevent the detection surface 112 from being soiled.

Further, in this embodiment, a space 203*c* is provided between the rectifier plate 206 and the inside wall 203*b* (other inside wall of first portion 203A), that is, the one closer to the intake portion 204. Therefore, as air flows out of the branch portion 203, a part of the air collides with the rectifier plate 206, being thereby changed in direction. Then, both streams of air are discharged from the exhaust opening 205*a*. Therefore, the sensor unit 100 in this embodiment is uniform in the air distribution across the exhaust opening 205*a*. That is, this embodiment can make a sensor unit (100) uniform in the air distribution across its exhaust opening (205*a*).

Here, as air flows through the branch portion 203, it flows along one of the inside walls 207 of the first portion 203A of the branch portion 203. In the second portion 203B, the air tends to flow through the portion of the first portion 203A, which is opposite from the inside wall 207 mentioned above. Without the presence of the rectifier plate 206, as air comes out of the exhaust opening 205*a*, the farther it is from the intake opening 204*a*, the more outwardly the air flows. In this embodiment, therefore, the sensor unit 100 is provided with the rectifier plates 206. However, if all the rectifier plates 206 are similarly positioned relative to the corresponding exhaust portions 205*a*, for example, each rectifier plate 206 is positioned at roughly the center of the corresponding exhaust opening 205*a*. Therefore, it is possible that the following problem will occur. That is, the portion of each exhaust opening 205*a*, which is on the same side of the rectifier plate 206 as the intake opening 204*a*, will become insufficient in the amount of airflow. In this embodiment, therefore, each rectifier plate 206 is positioned, relative to the corresponding exhaust opening 205*a*, in such a manner that the farther it is from the intake opening 204*a*, the more outward it is disposed. That is, it is positioned to satisfy an inequality ($a<b<c$), as shown in FIG. 19. By the way, "a, b and c" stand for the distance from the rectifier plate 206 and the closer inside wall 205*c* of the exhaust opening 205*a* to the intake opening 204*a*, for the three exhaust portions 205, listing from the closest one to the intake opening 204*a*.

That is, each of the multiple exhaust portions 205 has the first portion and the second portion, which is farther from the intake portion 204 than the first portion. The first portion 203A and second portion 203B correspond to the first and second exhaust portions, respectively. Each of the multiple rectifier plates 206 has the first rectifying portion with which the first exhaust portion is provided, and the second rectifying portion, with which the second exhaust portion is provided. It is assumed here that the right exhaust portion 205, shown in FIG. 19, is the first exhaust portion, and the rectifier plate 206, with which this exhaust portion 205 is provided, is the first rectifying portion. It is also assumed here that the left exhaust portion 205, shown in FIG. 19, is the second exhaust portion, and the rectifying plate 206, with which this exhaust portion 205 is provided, is the second rectifying portion. In this case, the distance c between the inside wall 205 of the first exhaust portion, which is closer to the intake portion 204, and the first rectifying portion is made longer than the distance a between the inside wall 205*c*, which is closer to the intake portion 204, and the second rectifying portion ($a<c$). That is, the distance c between the inside wall 205*c* of the second portion 203B, which is continuous to the inward surface 207 of the first portion 203A of the second exhaust portion, and the second rectifying portion c is made longer than the distance a between the inside wall 205*c* of the first portion 203B, which is continuous to the inside wall 207 of the first portion 203A of the first exhaust portion, and the first rectifying portion exhaust portion 205, which is closer to the intake portion 204, and the first rectifying portion.

Referring to FIG. 19, the positional relationship between right exhaust portion (first exhaust portion) and rectifying plate 206 (first rectifying portion), and that between the central exhaust portion 205 (second exhaust portion) and the rectifying plate 206 (rectifying portion) also satisfies the inequality ($a<b$). Referring also to FIG. 19, the central exhaust portion (second exhaust portion) and the left exhaust portion 205 and rectifying plate 206 (second rectifying portion) satisfies the inequality ($b<c$). Therefore, it is possible to prevent the occurrence of such a problem that the closer portion of the exhaust opening 205*a* of the exhaust portion 205, to the intake portion 204 becomes insufficient in the amount of airflow. Therefore, each exhaust opening 205*a* is uniform in the amount of airflow across its entire range.

That is, the sensor unit 100 in this embodiment is structured so that its exhaust openings 205*a* are greater in number than its intake opening 204*a*, and yet, it can prevent soiling matters from adhering to its registration sensors 102 and density sensors 103. That is, providing each exhaust opening 205*a* with the rectifying plate 206 makes it possible to make the exhaust opening 205*a* proper in the amount and direction of airflow. Further, positioning the rectification plate 206 in each exhaust opening 205*a* in such a manner that its position in the exhaust opening 205*a* reflects the distance of the exhaust opening 205*a* from the intake opening 204*a*, can make each exhaust opening 205*a* uniform in the amount and direction of airflow. Therefore, it is possible to make a proper amount of air flow across the entire range of the detection surface 112 of each of the registration sensors 102 and density sensors 103. Therefore, it is possible to prevent the toner or the like soiling matters from adhering to the detection surfaces 112.

Embodiment 2

Referring to FIG. 20, the second embodiment of the present invention is described. In this embodiment, a part of each rectifying plate 206A is eliminated. Otherwise, the sensor unit 100 in this embodiment is the same in structure and function as that in the first embodiment described above. Therefore, the portions of the sensor unit 100 in this embodiment, which are similar in structure to the counterparts in the first embodiment are given the same referential codes as those given to the counterparts, and are not described, or simplified in description and/or illustration. That is, the description of this embodiment primarily concerns the portions of the sensor unit 100 in this embodiment, which are different from the counterparts in the first embodiment.

In the case of the sensor unit 100 in the first embodiment, providing the rectification plates 206 sometimes makes the remote side of the exhaust opening 205*a* from the intake opening 204*a*, smaller in the amount of airflow than the closer side. In this embodiment, therefore, the rectification plates 206A are differently shaped from those in the first embodiment; the portion (230) of each rectification plate 206A, which is next to the exhaust opening 205*a* is cut off. That is, each rectification plate 206A is shaped so that a gap 230 is provided between itself and inside wall of the exhaust opening 205*a*, as shown in FIG. 2.

As described above, providing the gap 203 between the rectification plate 206A and inside wall of the exhaust opening 205*a* makes it possible to allow a part of the airflow which flowed to the rectification plate 206A, to flow by the rectification plate 206A at the same angle as it arrived at the rectification plate 206A. Therefore, it is possible to ensure that the remote side of the exhaust opening 205*a* from the intake opening 204*a* is provided with a proper amount of airflow.

Embodiment 3

Next, referring to FIG. 21, the third embodiment of the present invention is described. In this embodiment, the sensor unit 100 is structured so that the height H2 of the rectification plate 206B is less than the height H1 of the air passage of the exhaust portion 205. Otherwise, the sensor unit 100 in this embodiment is similar in structure and function to the sensor unit 100 in the first embodiment described above. Therefore, the portions of the sensor unit 100 in this embodiment, which are similar in structure to the counterparts in the first embodiment, are given the same referential codes as the counterparts in the first embodiment, and are simplified in illustration and description, or not illustrated nor described. That is, only the portions of the sensor unit 100 in this embodiment, which are different from the counterparts in the first embodiment are described.

In the case of the structural arrangement for the sensor unit 100 in the first embodiment, providing the rectification plates 206 sometimes makes the remote side of the exhaust opening 205*a* from the intake opening 204*a* smaller in the amount of airflow. In this embodiment, therefore, the sensor unit 100 is structured so that the height H2 of the rectification plate 206B is less than the height H1 of the air passage (H2<H1) as shown in FIG. 21.

Here, the height H2 of the rectification plate 206B means the height by which the rectification plate 206B protrudes from the inside wall 205*d* which is roughly parallel to the wall portion 211*a* (FIG. 13), on the upstream side of the inward wall 205*b* from which the rectification plate 206B protrudes, toward the wall portion 11*a*. Further, the height H1 of the air passage means the gap between the inside wall 205*d* and wall portion 211*a*. That is, assuming that the height direction (left-right direction of FIG. 13) is the thickness direction of the air passage in the exhaust portion 205, the maximum length of the rectification plate 206B in terms of the height direction of the rectification plate 206B is the height H, and the largest gap between the top and bottom inside surfaces of the air passage of the exhaust portion 205 is height H1.

In other words, the rectification plate 206B is disposed so that a gap is provided between the rectification plate 206B, and the wall portion 311*a* which is on the side of the exhaust opening 205*a*, from which air is discharged from the exhaust opening 205*a*. Therefore, it is possible to allow a part of the air to flow without changing it in the angle of flow, as air moves thereto along the inside wall 207 of the branch portion 203 of the sensor duct. Therefore, it is possible to ensure that the opposite portion of the exhaust opening 205*a* from the intake opening 204*a* is provided with a proper amount of airflow.

By the way, the structural arrangement for the sensor unit 100 in this embodiment, and the structural arrangement for the sensor unit 100 in the second embodiment, may be employed in combination. That is, the rectification plate 206B may be shaped so that a gap 230 is provided between the rectification plate 206B and the opening side of the exhaust opening 205*a*.

<Others>

In the embodiment described above, the sensor unit 100 is provided with the shuttering member 106. However, the present invention is applicable to the sensor unit 100 even if the sensor unit 100 is not provided with the shuttering member 106.

Further, in each of the embodiments described above, the moving member was the intermediary transferring member. The preceding embodiment, however, was not intended to limit the present invention in scope. For example, the present invention is also applicable to an apparatus, the movable member of which is a recording medium bearing member, instead of the intermediary transferring member. That is, the present invention is also applicable to an image forming apparatus of the so-called direct transfer type, which forms an image by directly transferring a toner image onto a sheet of recording medium borne by a recording medium bearing member. As the recording medium bearing member, an endless belt which is similar to the intermediary transfer belt 7 in the embodiment described above may be used. Also in an image forming apparatus of this type, such a control is carried out that referential images (registration patch and density patch) are formed on a recording medium bearing member, or a sheet of recording medium borne by a recording medium bearing member, and these referential images are detected by sensors (registration sensors and density sensors) to correct an image forming apparatus in color deviation and/or image density. Therefore, effects which are similar to those obtainable by the image forming apparatus 10 in the embodiment described above can be obtained by applying the present invention to this type of image forming apparatus.

Moreover, the movable member may be a photosensitive member which is in the form of a drum or an endless belt. The effects which are similar to those obtainable by each of the embodiments described above are obtainable by the application of the present invention to any sensor unit for detecting a referential image formed on the photosensitive member.

Further, in each of the embodiments described above, the sensors (registration sensors and density sensors) were optical sensors. The preceding embodiment, however, is not intended to limit the present invention in scope in terms of sensor selection. That is, the present invention is also applicable to a sensor unit (image forming apparatus) as long as the sensors employed by the sensor unit are such sensors that have a detection surface positioned in a manner to oppose a movable member, and detect the state of an object on the movable member, through their detection surface. For example, the sensor may be a potential sensor for detecting the surface potential of the movable member, as the state of the movable member. A potential sensor is preferably employable in a case where the movable member is a photosensitive member.

According to the present invention, it is possible to provide a sensor unit which is structured so that its exhaust openings are greater in number than its intake opening, and yet, is capable of preventing soiling matters adhering to its sensors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-136194 filed on Jul. 19, 2018, which is hereby incorporated by reference herein in its entirety.

What is claimed is:

1. A sensor unit detachably mountable to an image forming apparatus, the sensor unit comprising:

a first sensor configured to detect a toner image formed on an image bearing member;

a second sensor provided at a position different from a position of the first sensor in a widthwise direction perpendicular to a moving direction of the image bearing member and configured to detect the toner image formed on the image bearing member;

a sensor holder supporting the first sensor and the second sensor;

a casing accommodating the sensor holder; and a duct portion provided in the casing and constituting a flow path configured to direct air toward the first sensor and the second sensor, wherein the duct portion includes a suction portion configured to suction the air into the duct portion, a first discharging portion configured to discharge the air suctioned by the suction portion into a location between the first sensor and the image bearing member, a second discharging portion configured to discharge the air suctioned by the suction portion into a location between the second sensor and the image bearing member, a first branch path branched out at a position downstream of the suction portion in a discharging direction of the duct portion and connecting the suction portion and the first discharging portion, and a second branch path branched out at a position downstream of the suction portion in the discharging direction and connecting the suction portion and the second discharging portion, and wherein the suction portion is disposed between the first discharging portion and the second discharging portion in the widthwise direction.

2. The sensor unit according to claim 1, wherein the duct portion is positioned upstream of the first sensor and the second sensor with respect to the moving direction of a peripheral surface of the image bearing member.

3. The sensor unit according to claim 1, wherein the first branch path includes a first flow path extending along the widthwise direction and configured to feed the air suctioned by the suction portion in the widthwise direction and a second flow path connecting the first flow path and the first discharging portion and configured to feed the air flowing in the first flow path in the moving direction of a periphery of the image bearing member.

4. A sensor unit according to claim 3, wherein as viewed in the widthwise direction, an inner wall of the second flow path includes an inclined portion inclined so as to be closer to the first sensor as the inclined portion approaches the image bearing member.

5. The sensor unit according to claim 3, further comprising a first wall portion provided in a connecting portion between the first flow path and the second flow path and configured to divide the air flow in the first flow path to positions different from each other in the widthwise direction and to guide the divided air toward the first discharging portion.

6. The sensor unit according to claim 5, wherein the first wall portion is provided with a cut-away portion so that the air divided by the first wall portion merges at a position upstream of the first discharging portion.

7. The sensor unit according to claim 5, further comprising a third sensor provided on a same side as the first sensor with respect to the suction portion in the widthwise direction, at a position more remote from the suction portion than the first sensor, and a third branch path configured to guide the air suctioned by the suction portion to a third discharging portion configured to discharge the air suctioned by the suction portion toward a location between the third sensor and the image bearing member.

8. The sensor unit according to claim 7, wherein the third branch path includes a third flow path extending along the widthwise direction and configured to feed the air suctioned by the suction portion in the widthwise direction, a fourth flow path connecting the third flow path and the third discharging portion and configured to feed the air flowing in the third flow path in the moving direction, and a second wall portion provided in a second connecting portion between the third flow path and the fourth flow path and configured to divide the air flow flowing in the third flow path to positions different in the widthwise direction and to guide the divided air toward the second discharging portion.

9. The sensor unit according to claim 8, wherein as viewed in the widthwise direction, a first distance between the first wall portion and an end portion of the first discharging portion provided adjacent to the suction portion is shorter than a second distance between the second wall portion and an end portion of the third discharging portion provided adjacent to the suction portion.

10. The sensor unit according to claim 1, further comprising a supporting portion supporting the sensor holder so as to be movable relative to the casing.

11. The sensor unit according to claim 10, further comprising a fan rotatably provided in the casing and configured to feed the air into the duct portion.

12. The sensor unit according to claim 11, further comprising a relaying duct portion mounted on the casing and configured to suction the air flow supplied from the fan and to discharge the air flow into the duct portion.

* * * * *